US009550104B2

(12) United States Patent
Taft

(10) Patent No.: US 9,550,104 B2
(45) Date of Patent: Jan. 24, 2017

(54) GOLF TRAINER SYSTEM AND METHOD

(71) Applicant: Carlton Taft, Thousand Palms, CA (US)

(72) Inventor: Carlton Taft, Thousand Palms, CA (US)

( * ) Notice: Subject to any disclaimer, the term of this patent is extended or adjusted under 35 U.S.C. 154(b) by 0 days.

(21) Appl. No.: 14/819,741

(22) Filed: Aug. 6, 2015

(65) Prior Publication Data

US 2016/0038816 A1 Feb. 11, 2016

Related U.S. Application Data

(60) Provisional application No. 62/034,277, filed on Aug. 7, 2014, provisional application No. 62/164,761, filed on May 21, 2015.

(51) Int. Cl.

| | |
|---|---|
| ***A63B 69/36*** | (2006.01) |
| *A63B 47/00* | (2006.01) |
| *A63B 71/06* | (2006.01) |

(52) U.S. Cl.

CPC ..... *A63B 69/3667* (2013.01); *A63B 69/3623* (2013.01); *A63B 47/002* (2013.01); *A63B 69/3641* (2013.01); *A63B 69/3676* (2013.01); *A63B 2071/0694* (2013.01); *A63B 2208/0204* (2013.01); *A63B 2210/50* (2013.01); *A63B 2225/09* (2013.01)

(58) Field of Classification Search

USPC ..... 473/218, 272, 273

See application file for complete search history.

(56) References Cited

U.S. PATENT DOCUMENTS

| | | | | |
|---|---|---|---|---|
| 1,517,555 A | | 12/1924 | Graham | |
| 2,150,580 A | * | 3/1939 | Crowley | A63B 69/3667 33/508 |
| 2,169,407 A | * | 8/1939 | Crowley | A63B 69/3667 473/272 |
| 2,886,326 A | | 5/1959 | Olds | |
| 3,166,327 A | | 1/1965 | Champion | |
| 3,229,981 A | | 1/1966 | Taber | |
| 3,459,429 A | | 8/1969 | Green | |
| 3,868,116 A | | 2/1975 | Ford et al. | |
| 4,000,905 A | | 1/1977 | Shirhall | |
| 4,023,810 A | | 5/1977 | Lorang | |
| 4,146,231 A | | 3/1979 | Merkle et al. | |
| 4,164,352 A | | 8/1979 | O'Brien | |

(Continued)

OTHER PUBLICATIONS

International Search Report and Written Opinion of the International Searching Authority for International Application No. PCT/US15/43999, Mailed Nov. 6, 2015, twelve pages.

*Primary Examiner* — Nini Legesse

(74) *Attorney, Agent, or Firm* — David J. Dawsey; Michael J. Gallagher; Gallagher & Dawsey Co., LPA

(57) ABSTRACT

An adjustable golf swing training device for use with multiple different golf clubs having a template frame partially surrounding and defining a ball hitting area. A club selection bar slidably cooperates with the primary longitudinal frame section so that movement of the club selection bar with respect to the primary longitudinal frame section aligns the club indicia for one of the multiple different golf clubs with the club face alignment tab and establishes the location of the front foot marker and the back foot marker to inform a user of the proper foot locations for the golf club when a golf ball is positioned in the ball hitting area and aligned with the club face alignment tab.

20 Claims, 25 Drawing Sheets

(56) References Cited

U.S. PATENT DOCUMENTS 4,322,084 A * 3/1982 Reece ..... A63B 69/3667 473/273
4,355,810 A 10/1982 Rydeck
4,384,718 A 5/1983 Cachola
4,544,160 A 10/1985 Miner
4,563,010 A 1/1986 McDorman et al.
4,583,739 A 4/1986 Kabbany
4,718,674 A * 1/1988 Henry ..... A63B 69/3623 473/218
4,736,952 A 4/1988 Taft et al.
4,915,384 A 4/1990 Bear
4,962,933 A 10/1990 Awazu et al.
5,035,433 A 7/1991 Durso
5,108,106 A 4/1992 Cook
5,139,263 A * 8/1992 Feo ..... A63B 69/36 473/218
5,163,686 A 11/1992 Bergman
5,171,017 A 12/1992 Betancourt
5,246,234 A 9/1993 Zambelli
5,306,011 A 4/1994 Perry
5,314,186 A 5/1994 Lee
5,335,915 A 8/1994 Baudier
5,350,177 A 9/1994 Furbush, Jr.
5,362,060 A 11/1994 Hinson
5,388,833 A 2/1995 Goyen, Jr.
5,411,266 A 5/1995 Guthry
5,415,407 A 5/1995 Beatty
5,435,727 A 7/1995 Dobson
5,464,220 A * 11/1995 Hansen ..... A63B 69/3667 473/218
5,492,328 A 2/1996 Lundquist
5,549,298 A 8/1996 Cullen et al.
5,893,805 A 4/1999 Douglass
5,944,613 A 8/1999 Dubois
5,951,409 A 9/1999 Calley
5,984,801 A 11/1999 Mason
6,077,169 A 6/2000 Florian
6,106,408 A 8/2000 Roman
6,142,883 A * 11/2000 Ferrara ..... A63B 69/3667 473/218
6,227,984 B1 5/2001 Blankenship
6,346,050 B1 2/2002 Larson
6,440,004 B1 8/2002 Rodriguez
6,592,376 B1 7/2003 Carpenter
6,743,111 B2 6/2004 Mindlin
6,821,211 B2 11/2004 Otten et al.
7,022,026 B2 4/2006 Blankenship
7,112,144 B2 9/2006 Mindlin
7,131,910 B2 11/2006 Townsend, II
D535,345 S 1/2007 Davis et al.
7,186,184 B2 3/2007 Buck
7,527,562 B1 5/2009 Mason
7,607,987 B2 10/2009 Alter
7,713,061 B1 5/2010 Albertini
7,744,482 B1 6/2010 Watson
7,766,758 B2 8/2010 Clark
7,927,227 B2 4/2011 Radcliffe et al.
7,997,994 B2 8/2011 Hensel
8,021,242 B1 9/2011 Tennison
8,062,144 B2 11/2011 Conway
8,066,580 B2 11/2011 Conway
8,100,778 B2 1/2012 Willis
8,182,370 B1 5/2012 Neel, III
8,221,256 B2 7/2012 Broering
8,282,502 B1 10/2012 Angstead et al.
8,608,584 B1 12/2013 Cobb
8,747,243 B2 6/2014 Gibbs et al.
8,758,150 B1 6/2014 Parker
8,834,287 B1 9/2014 Reid
8,998,738 B1 4/2015 Dillon et al.
9,089,757 B2 7/2015 O'Donovan
2003/0130055 A1 7/2003 Townsend, II
2005/0227774 A1* 10/2005 Buck ..... A63B 69/3667 473/218
2006/0019763 A1 1/2006 Anderson
2006/0094519 A1 5/2006 Wynne
2007/0021227 A1 1/2007 Towsen
2008/0102973 A1 5/2008 Bennett
2009/0029789 A1 1/2009 Davies
2012/0135816 A1 5/2012 West
2013/0337928 A1 12/2013 Scott

* cited by examiner (Fig. 2 at A - A')

(Fig. 1 at B - B')

GOLF TRAINER SYSTEM AND METHOD

CROSS REFERENCE TO RELATED APPLICATIONS

This application claims the benefit of U.S. provisional patent application Ser. No. 62/034,277, filed on Aug. 7, 2014, and U.S. provisional patent application Ser. No. 62/164,761, filed on May 21, 2015, all of which are incorporated by reference as if completely written herein.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

TECHNICAL FIELD

The present invention relates generally to sports training equipment. The present invention relates more specifically to training aids for developing skills associated with the play of the sport of golf with particular emphasis on the form and method of a golf swing.

BACKGROUND OF THE INVENTION

One embodiment of the present invention is a golf trainer that is a template that is placed on the ground and provides a visual presentation of many fundamental set up and alignment functions for a golfer to consider when attempting to strike a golf ball correctly. This trainer will create the proper muscle memory for a consistent and more "perfect" golf swing. The template may be composed of multiple distinct sections that may be used together or independently.

One embodiment of the trainer is made in the shape of a rectangle with an arrow shape at one end. The ball is placed within the frame of the trainer and the graphics printed on the trainer provide a visual template that identifies key the aspects of proper alignment between the golfer, the club, the ball and the target. Because the ball is placed within the frame, the golfer has an overview of many functions that must be considered at one time and this causes the golfer to focus and concentrate more on each practice swing which builds proper muscle memory and results in a more "perfect practice".

SUMMARY OF THE INVENTION

One, or more, of the following set up and alignment functions are addressed with the use of indicia on the trainer and the method of using the trainer to practice a golf swing:

Line of Flight—Target Line—Alignment to the flag;

Club Face Alignment—Align the club face with the target;

Line of Stance—Alignment of feet with target line; Alignment of left foot; Alignment of right foot; and setting the width of stance in relation to club selection;

Ball Position—Ball position in stance in relation to club selection, the proper distance from the ball in relation to the club selected;

Club Swing Path—Backswing, sweep the club; forward swing, point of impact, hit through the ball;

Ball Control—Straight shot/fade/draw; and

Putter Alignment.

Some embodiments of the trainer of the present invention use a "crosshairs alignment system" for a more accurate set up and alignment. The trainer will help most all golfers to improve their game. From beginners to low handicap golfers, proper set up and alignment are necessary for a good golf shot. The "crosshairs alignment system" of the present invention provides positive muscle memory for a more "perfect practice". The various functional aspects of the trainer are described below.

(A) Line of Flight to the Target—This is the process of aligning the flight of the ball to the target. The front of the trainer may be shaped like an arrow that is pointed to the target and may be aligned with the "crosshair alignment marks" on the other end of the trainer giving a more accurate alignment to the target.

(B) Club Face Alignment—This is the process of aligning the face of the golf club at a right angle to the line of flight. In some embodiments the ball is placed between the club face alignment tabs, which are positioned directly across from each other on either side of the horizontal bars of the frame. The tabs have at least one reference feature, often a line or series of lines, that is perpendicular to the target axis. When the club selected is placed in position to prepare to hit the ball, the line, or lines, on the club face alignment tabs should be substantially parallel to score lines or grooves on the face of the golf club. By seeing the line, or lines, on the alignment tabs substantially parallel with the lines on the face of the golf club, the golfer can immediately determine if the club face is aligned correctly in relationship to the target. Alternative embodiments include a club face alignment tab that is placed on, and slides left and right along, the club selection bar. The club face alignment tab has an alignment mark on it that is the same as the alignment mark on the club selection bar associated with each club. The club face alignment tab has a window cut out of it so that the golfer can see the marking for the club they are going to use. The golfer selects a club to use by sliding the club face alignment tab along the club selection bar until the alignment mark for the club being used is in alignment with the alignment mark on the club face alignment tab. When the club selected is placed in position to prepare to hit the ball, the alignment lines on the club face alignment tab should be parallel to the lines that are cut into the face of the golf club. By seeing the lines on the club face alignment tab in line with the lines on the face of the golf club, the golfer can immediately determine if the club face is aligned correctly, at a right angle to the target. The combination of the alignment marks on the swing path guide showing the proper alignment to the target and the club face alignment tabs on the club selection bar showing the proper alignment of the club selected provide the golfer a visual representation of a perfect alignment. Either, or both, the club selection bar or the club face alignment tab may include a vertical projection that is easily engaged by a golf club head to slide the club selection bar in relation to the template frame, or slide the club face alignment tab in relation to the club selection bar, as will be described later in greater detail.

The combination of the alignment marks showing the proper alignment to the target and the club face alignment tabs showing the proper alignment of the club selected, create a "crosshair" effect which provide the golfer a visual representation of a perfect alignment.

(C) Line of Stance—This is the process of aligning the feet parallel to the target line. Once the trainer is aligned to the target and the club face is aligned to the target, the golfer then uses the bar closest to him to visualize the alignment of his feet in relation to the alignment of the ball to the target. This line of stance should be parallel to the target line. Some embodiments include Stance Guide Markers on the outer edges of the swing path guide which give a visual guide to the golfer for aligning the club selection bar in line with the swing path guide and parallel to the line of flight. Once the swing path guide is aligned to the target and the club face is aligned to the target, the golfer then uses the club selection bar to visualize the alignment of his feet in relation to the alignment of the ball to the target.

(D) Ball Position and Foot Placement—This is the process of positioning the ball and the feet for the different clubs. In several embodiments the trainer has a club selection bar with indicators of which club is being used from a driver to a wedge, as well as markers showing where the ball and the feet should be placed in relation to the club being used. These may include: (a) a lead foot marker, which in the preferred embodiment is a colored mark on the bar closest to the lead foot. In one embodiment this indicates that the outside toe of the lead foot should be aligned with this marker and that the lead foot is placed slightly open, however in an alternative embodiment it may indicate the location that the inside toe of the lead foot should be aligned; (b) an optional lead foot long-club heel marker, which may be a differently colored mark in the preferred embodiment, next to the lead foot marker that indicates proper heel alignment for certain golf clubs, which in one embodiment is for woods and long irons, or golf clubs having a length over a predetermined length such as 40", 41", 42", or 43", such as when using a driver or fairway woods; (c) an optional lead foot mid-to-short-club heel marker, which may be yet another differently colored mark in the preferred embodiment, next to the lead foot long-club marker, that indicates proper heel alignment when playing irons; and (d) a rear foot marker, which may again be a colored indicator, at the opposite end of the bar that indicates where the back foot should be placed in relation to the club being used.

The golfer may use the club selection bar to establish proper foot placement. The golfer may use their golf club head to engage and slide the bar to where the indicator for the club being used is in alignment with the center mark on the club face indicator tab closest to him. The golfer then places his feet in the positions indicated by the markers on the bar. These markers are used as a reference of where the lead foot and back foot should be placed in relationship to the ball. The driver is played off the heel of the lead foot and the fairway woods are played slightly behind the driver, the long irons slightly behind the fairway woods and the short irons slightly behind the long irons. The markings on the club selection bar indicate to the golfer that the driver, the fairway woods, and the long irons are played with a wider stance and the stance gets narrower as the shorter irons are used.

Alternatively, in embodiments incorporating a club face alignment tab the golfer places the club face alignment tab on the club selection bar and uses their golf club head to engage and slide the club face alignment tab to where the alignment indicator on the club face alignment tab is in alignment with the alignment mark on the club selection bar for the club being used. The golfer then places their feet in the positions indicated by the markers on the club selection bar. These markers are used as a reference of where the front foot and back foot should be placed in relationship to the ball. The driver is played close to the heel of the front foot and the fairway woods are played slightly behind the driver, the hybrids and long irons slightly behind the fairway woods and the short irons slightly behind the long irons. The markings on the club selection bar indicate to the golfer that the driver, the fairway woods, and the hybrids and long irons are played with a wider stance and the stance gets narrower as the shorter irons are used.

(E) Club Swing Path—This is the process of defining the swing path for ball control for a straight shot, a fade shot, or a draw shot. In one embodiment there is the Backswing Path. A three stripe (red, white, and blue in the preferred embodiment) swing path marker strip is positioned at the end of the trainer closest to the back foot. The club is brought back over this marker in a sweeping motion keeping the club head close to the ground. This helps prevent the golfer from picking the club up rather than sweeping it back. There may also be one, or more, markers to indicate the path for the forward swing depending on if the golfer wants a straight shot, a draw shot or a fade shot. The club swing path should always extend over the arrow end of the trainer for every shot for a complete follow through. The club face should be kept facing the target at the point of impact. For a straight shot, the path of the club should go over a center marker, or in some embodiments between multiple center lines, at the tip of the arrow portion of the trainer. For a draw shot, the path of the club should go over an outside forward swing marker, or in some embodiments between multiple draw marker lines, at the arrow end of the trainer. For a fade shot, the path of the club should go over the inside forward swing marker, or in some embodiments between multiple fade marker lines, at the arrow end of the trainer.

The swing path guide also include motion sensor activated lights and/or audio devices and/or speed sensing devices to provide the golfer with a visual and/or audio feedback indicating the area of the swing path guide that the golf club passed over after striking the ball and the speed of the club as it passed over the swing path guide. The typical swing path of a golf shot is described further. The swing starts with the backswing. The club is brought back over the end of the club selection bar towards the golfer's back foot. Once the golfer has completed the backswing, the golfer then proceeds to swing the club forward to strike the ball and continues the swing over the swing path guide using the swing path markers on the swing path guide as a visual guide depending on the type of shot the golfer is attempting.

The above swing path description and the structure of the markers etc. (red for fade, blue for draw) are for a right handed golfer. The swing path description and the structure of the markers will change accordingly for a left handed golfer, with the red marker being used for a draw shot and the blue marker for a fade.

(F) Proper Stance and Distance from the Ball Path—This is the process of defining the proper place to stand in relation to the club being used. The club selection bar gives a visual reference for the width of the stance and the position of the ball off the heel of the front foot. One embodiment incorporates a golfer stance template that when placed at a spaced distance to and adjacent the trainer at the club face alignment tab closest to the golfer to provide a reference as to how close to the ball a golfer should stand in relation to the club being used. The driver, fairway woods, etc. are played further away from the ball so as to allow the swing to be a full sweeping motion.

(G) Putter Alignment—This process involves an alternate use of the trainer and is designed to allow a golfer to practice putting as well. In an embodiment facilitating practice putting, alignment strips are placed directly across from each other on either side of the trainer that are approximately two feet from the arrow shaped end of the trainer. There may be a circular cut out in the frame of the trainer at the arrow shaped end of the trainer. The ball is placed between the putter alignment strips and the combination of the putter alignment strips and the "crosshair alignment marks" on the trainer provide the proper alignment for a practice putt. When the golfer makes a practice putt, he can see the putter head move along the line of the putt. The cutout which is used as the target for the putt is smaller than the size of a standard cup in a green so that the golfer can refine their putting stroke and putt with more accuracy.

BRIEF DESCRIPTION OF THE DRAWINGS

Without limiting the scope of the present invention as claimed below and referring now to the drawings and figures:

Figure 1:
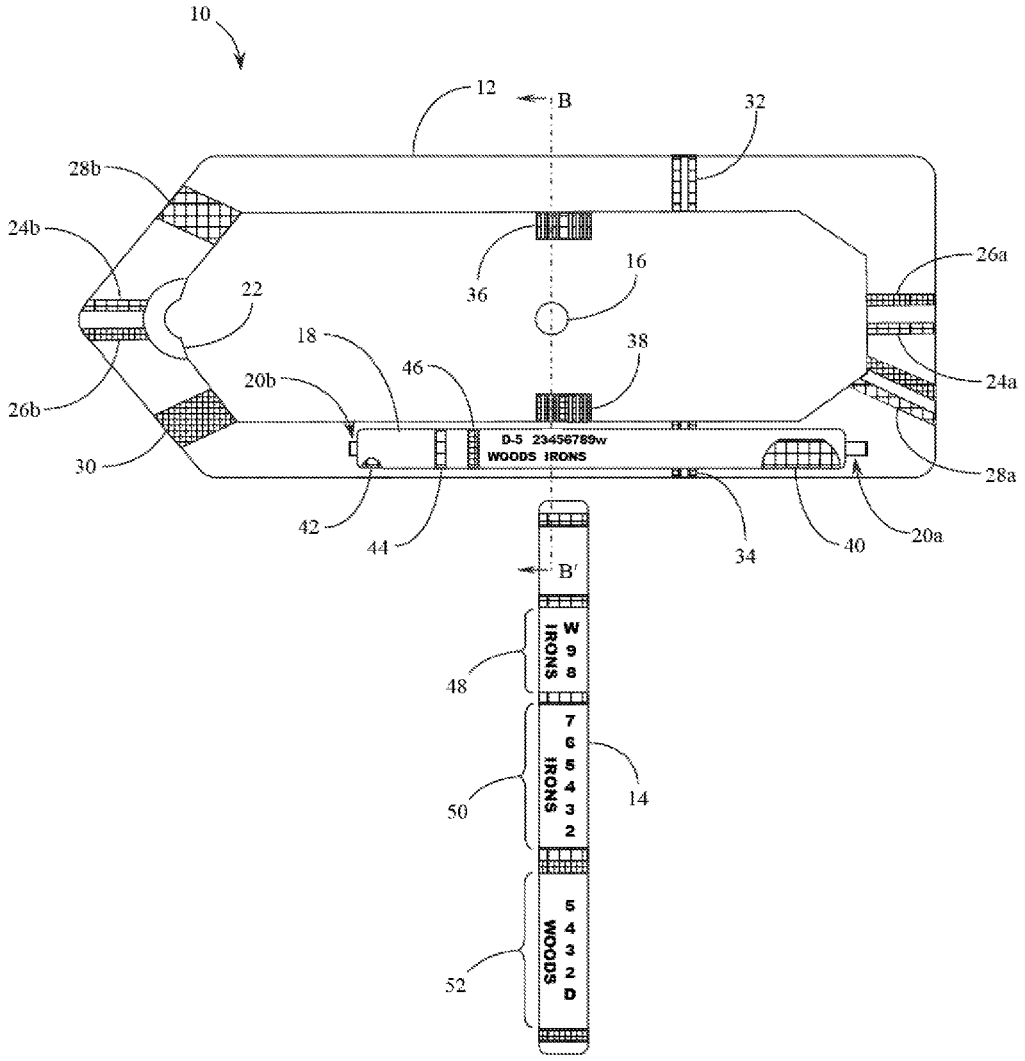
FIG. 1 is a top plan view of an embodiment of the golf swing training device of the present invention, fully assembled and ready for use.

These illustrations are provided to assist in the understanding of the exemplary embodiments of the training system and method as described in more detail below and should not be construed as unduly limiting the specification. In particular, the relative spacing, positioning, sizing and dimensions of the various elements illustrated in the drawings may not be drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE PREFERRED EMBODIMENTS

Reference is made first to FIG. 1 which is a top plan view of one embodiment of the golf swing training device of the present invention fully assembled and ready for use. In some embodiments the golf training template 10 is constructed primarily of template frame 12, which may be composed of a single piece or multiple individual sections, and some embodiments may include a golfer stance template 14. A golf ball 16 is shown in FIG. 1 for reference but may be alternately placed elsewhere within the template depending upon the specific application of the user. Golfer stance template 14 is an ancillary component that extends at a separated spacing from one of the long edges of template frame 12. Additionally, in some embodiments, positioned on template frame 12 is a club selection bar 18, which is a movable (slidable) component, which in one embodiment cooperates to slide within a selection bar slot, or multiple selection bar slots 20*a* & 20*b* as seen best in FIG. 3*a* and FIG. 15.

Figure 18:
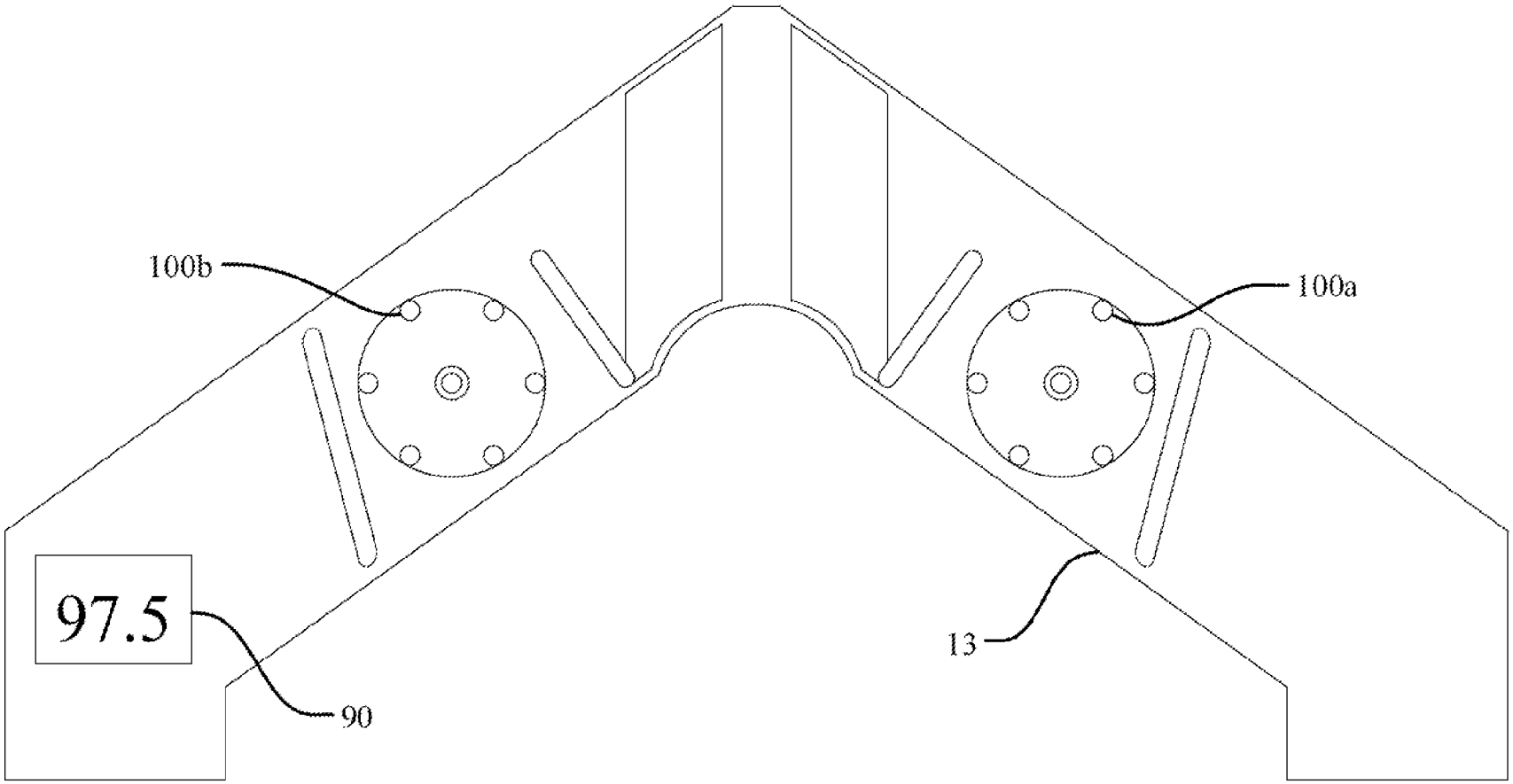
FIG. 18 is a detailed top plan view of an embodiment of the golf swing training device of the present invention.
Figure 19:
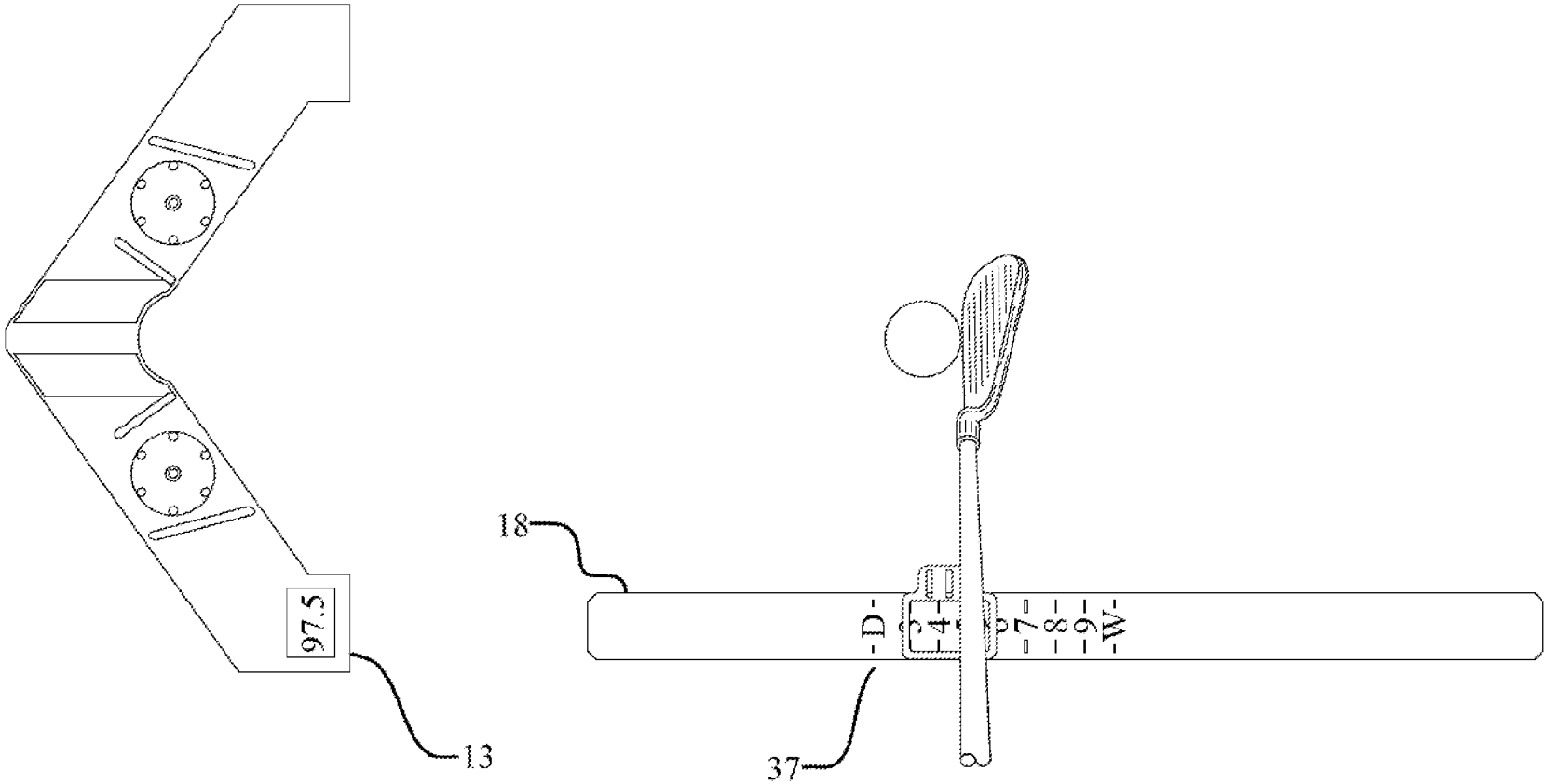
FIG. 19 is a detailed top plan view of an embodiment of the golf swing training device of the present invention.

In one embodiment, illustrated in FIG. 1, the template frame 12 is of unitary construction and generally rectangular in configuration with a pointed arrow side that is directed towards the target. Alternately, template frame 12 may be constructed in multiple pieces, which may be releasably attached to one another, or configured in rotational relationship to one another, for convenient storage, shipping, or to take only a portion onto the course while playing a practice round, such as the portions seen in FIG. 18 or FIG. 19. The multiple pieces may include interlocking end configurations to cooperate for easily assembly, disassembly, and selective use of certain components. Alternatively the device may incorporate hinges so that the template frame 12 may be easily folded into a compact storage configuration. In a further alternate manner, template frame 12 may be constructed of a flexible material that may be rolled up when not in use, or one or more sections of the template frame 12 may be permanently, or releasably, attached to a mat or flexible backing.

In the embodiment of FIG. 1 the rectangular frame is open in its center with a frame border around all of, or a portion of, the perimeter and providing locations for placement of a variety of different indicia used in the method associated with the training device of the present invention. The open center may be a void allowing it to be used on grass or alternatively the open center may include a mat or artificial turf. Initially herein one of many possible embodiment of the structure of the training device will be described followed by a detailed description of its method of use. In many embodiments the template frame 12 incorporates, as indicated above, various markings and indicia that are designed to facilitate carrying out the method of the present invention. These indicia or markings may include any one or more of the following: target line markers 24*a* & 24*b* (colored blue in an embodiment); target line markers 26*a* & 26*b* (colored red in an embodiment); swing path marker 28*a* (colored red, white, and blue in an embodiment); swing path marker draw shot 28*b* (colored blue in an embodiment); and swing path marker fade shot 30 (colored red in an embodiment). In further embodiments the template frame 12 may also include putting indicia such as upper putter alignment strips 32, seen in FIG. 1, and lower putter alignment strips 34, seen in FIG. 2. Additionally, another embodiment incorporates at least one club face alignment tab, for example the embodiment of FIG. 1 has positioned on the interior edge of the open template frame 12 an upper club face alignment tab 36 and a lower club face alignment tab 38. The function of these tabs is described in more detail below.

Additional indicia visible to the golfer are provided on club selection bar 18 and move with the bar, as described in more detail below. These selection bar indicia may include a back foot marker 40 (colored blue in an embodiment), and/or a lead foot marker 42 (also colored blue in an embodiment), as seen in FIG. 1. The club selection bar 18 may further include a heel marker indicia for woods 44 and/or a heel marker indicia for irons 46. These heel marker indicia 44 & 46 are preferably indicated with different colors, such as one blue and one red, to facilitate distinction between the two.

One embodiment further includes a golfer stance template 14 positioned as indicated in FIG. 1. The stance template 14 may be spaced apart a distance from a lower edge of template frame 12, as seen in FIG. 1, or it may abut, or even adjoin, the template frame 12 in alternative embodiments. The preferred distance between golfer stance template 14 and template frame 12 is determined by the reach of the specific golfer (a combination of height and arm length) and should be "referenced in" at the outset of the golfer's training regimen. The golfer will stand with one foot on either side of golfer stance template 14 at a distance dependent upon the specific club being used. The indicia placed on golfer stance template 14 are therefore directed to the various clubs that the golfer might use. In one embodiment seen in FIG. 5, these clubs are identified with indicia in three groups that include scoring club indicia for stance, which may include scoring club indicia 48 for short irons such as the 8-iron through wedge; mid-and-long iron indicia 50 for mid-irons and long irons such as the 2-iron, or hybrid, through 7-iron; and wood indicia 52 for the driver and woods having a loft less than 20 degrees.

Indicia related to club selection are also placed on club selection bar 18 and determine the lateral positioning of club selection bar 18 on the template frame 12, a piece of the template frame, or a mat 150. In the embodiment of FIG. 1 the club selection bar 18 slidably cooperates with the template frame 12 via one or more projections extending downward from the club selection bar 18 that slide within one or more cooperating recesses. The embodiment of FIG. 15 utilizes two selection bar slots 20*a* & 20*b* on each side of the template frame 12. In this embodiment the club selection bar 18 may be positioned on either side of the template frame 12 depending on whether the user is right or left handed, and the indicia is oriented so that it is easy to read regardless of the orientation. While in this particular embodiment two projections project downward from the club selection bar 18 to cooperate with the two selection bar slots 20*a* & 20*b* to ensure the club selection bar 18 slides longitudinally without the chance of rotation, this could also be accomplished with a single selection bar slot 20*a* that cooperates with a longitudinally extended projection, such as one having a length of one inch or more, to prevent unintended rotation of the club selection bar. Further, in yet another embodiment there are no downwardly extending projections on the selection bar 18 but rather the selection bar slot 20*a* is a recess 300, or channel, large enough to cooperate with a portion of the perimeter of the selection bar 18, such as that seen in FIG. 14, for example in one embodiment one half the thickness of the selection bar 18 sits down within a portion of the template frame 12 and slides within a portion of the template frame 12. In yet an even further embodiment the template frame 12 may include an upward projection, or projections, to cooperate with either a slot within the selection bar 18 or the perimeter of the selection bar 18 to allow easy sliding of the selection bar 18 with respect to the template frame 12. Thus, the selection bar 18 may have one or more male engagement projections to cooperate and slide within a feature of the template frame 12, or the template frame 12 may have one or more male engagement projections that cooperate with a portion of the selection bar 18, which may include a slot on the underside of the selection bar 18 or simply serve as a barrier around a portion of the perimeter of the selection bar 18, to guide its motion, and these are just a handful of manners in which the desired movement of the selection bar 18 may be achieved. The cooperating surfaces may include a friction reducing coating to promote smooth interaction between the stationary portion and the movable portion.

Figure 3A:
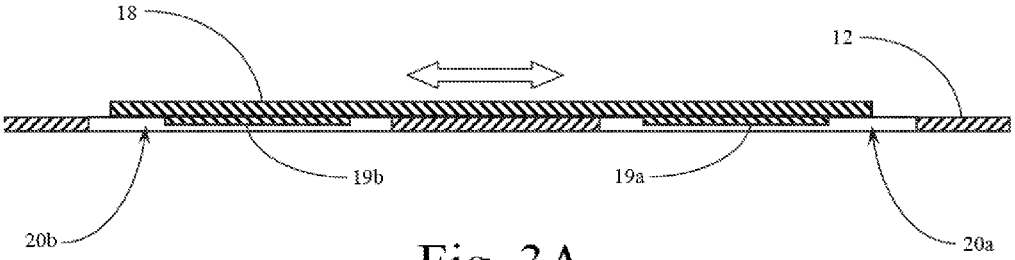
FIG. 3A is a cross sectional view of the golf swing training device of an embodiment of the present invention, viewed along section lines A-A in FIG. 2.

Training is most effective when the golfer can focus on the goals of the practice session rather break their concentration to adjust cumbersome appurtenances that are common with conventional training products. Ideally the golfer would not have to move from their stance to adjust a training product. This is why the present embodiments permit the user to adjust the position of the selection bar 18 without having to bend over or move from their practice position. The user can simply engage a portion of the selection bar 18 with a portion of the golf club, either the club head or the grip end, and slide the selection bar 18 to the appropriate location. In one embodiment this club head engagement is accomplished simply by having a portion of the perimeter of the selection bar 18 to be proud of, or extend upward away from, the adjacent top surface of the template frame 12, as seen in FIG. 3*a*, so that the user can engage the exposed perimeter with the golf club and slide the selection bar 18 accordingly. In one such embodiment a portion of the perimeter is proud of the adjacent top surface by a distance of at least ⅛ inch to facilitate easy engagement with a golf club, while in an even further embodiment it is at least ¼ inch. Alternatively, the selection bar 18 may include a club engagement projection, such as a post or a tab, extending upward from the top surface of the selection bar 18 that can be easily engaged by a golf club. In one such embodiment the club engagement projection extends at least ⅛ inch from the adjacent surface of the selection bar, while in an even further embodiment the club engagement projection extends at least ¼ inch. In yet another alterative embodiment the selection bar 18 may include a club engagement recess to accomplish the described engagement. In one such embodiment the club engagement recess is at least ⅛ inch below the top surface of the selection bar 18, while in a further embodiment it is at least ¼ inch. Even further, in yet another embodiment the club engagement recess is a round recess with a diameter of ¾"-1.5" to easily engage the butt end of the golf club grip. In still a further embodiment the selection bar 18 simply includes a change in surface elevation or texture to promote engagement with a golf club head. For instance, any of the indicia on the selection bar 18 may be recessed from the top surface of the selection bar 18, or project from the top surface of the selection bar 18, to achieve the desired engagement and slidability of the selection bar 18 with the golf club. Alternatively, in another embodiment at least a portion of the top surface of the selection bar 18 has a surface roughness equal to, or greater than, sandpaper having a CAMI Grit designation of 220.

Figure 2:
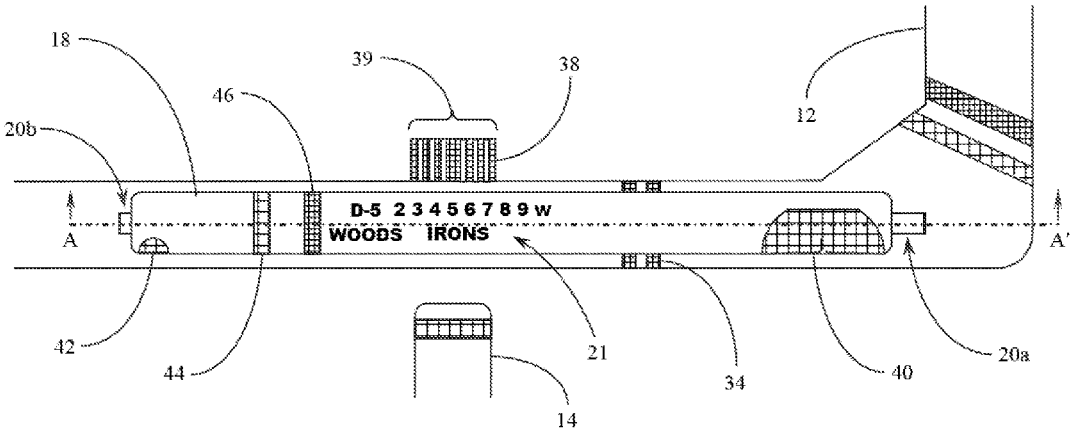
FIG. 2 is a detailed top plan view of an embodiment of the club selection bar portion of the golf swing training device of the present invention.
Figure 16:
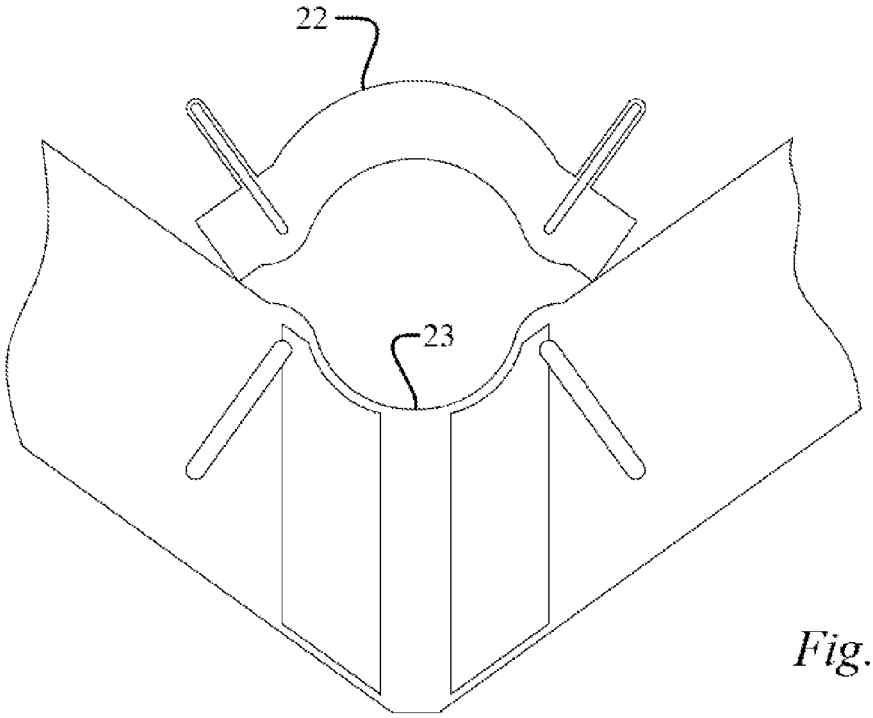
FIG. 16 is a detailed top plan view of an embodiment of the golf swing training device of the present invention.
Figure 17:
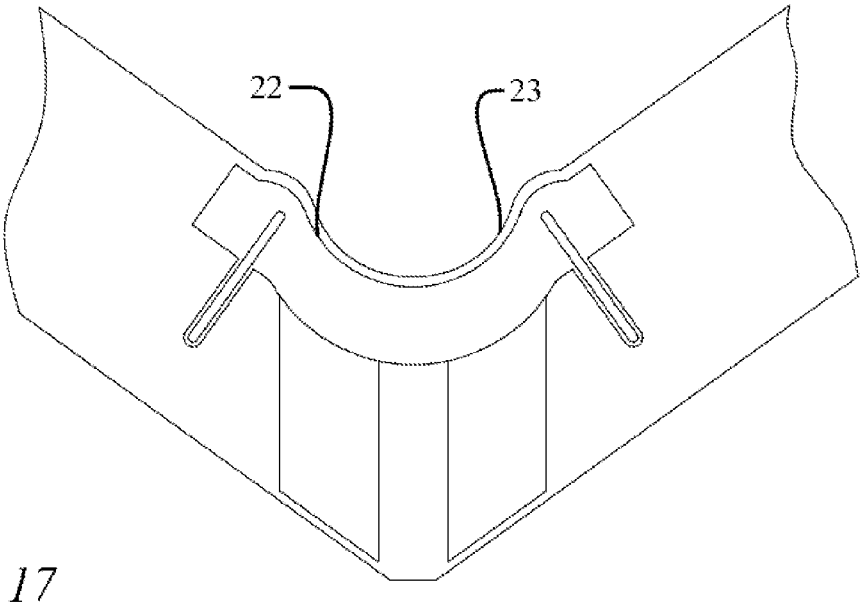
FIG. 17 is a detailed top plan view of an embodiment of the golf swing training device of the present invention.

The manner in which the golfer uses these variable components on the golf swing training device of the present invention is described in more detail below. In addition to providing golf swing training, in some embodiments the template frame 12 of the present invention also provides a putting training device that utilizes a number of the above-referenced indicia and template components. As indicated above, one embodiment may further include putter alignment strips upper and lower 32 & 34 are positioned on template frame 12, as seen in FIGS. 1 and 2, and/or a cup target cutout 22. A further embodiment, as seen in FIGS. 16 and 17, includes a removable target capture member 23 to prevent a golf ball from traveling over the cup target cutout 22. A combination of target line markers 24*a* & 24*b* as well as line markers 26*a* & 26*b* may provide a crosshair configuration with putter alignment strips 32 & 34 to allow the golfer to direct ball 16 into cup target cutout 22 for putting accuracy practice. While template frame 12 and golfer stance template 14 might be utilized in the actual play of a round of golf for purposes of improving individual swinging shots regardless of the position of the ball on the course, the putting function of the present invention would preferably be limited to practice putting as the rules of golf would generally prohibit placement of a limiting frame in any manner around the cup.

Reference is next made to FIG. 2 for a more detailed description of club selection bar 18 as it is positioned on template frame 12. The purpose of club selection bar 18 is to facilitate the proper placement of the golfer's feet and the placement of the ball in a manner that varies with regard to club selection. As described in further detail below, the golfer will typically identify a specific golf club to be used depending on the distance to the target and the preferred direction of flight. Once a club has been selected the golfer may slide club selection bar 18 in relation to the stationary template frame 12 to align the appropriate indicia on selection bar club indicia 21 with a portion of the club face alignment tab 38. By shifting club selection bar 18 to the left or right the indicators for placement of one or more of the golfer's feet (back foot marker 40 and lead foot marker 42) are also moved, which in some embodiments may include a heel marker, which in further embodiments may include a heel marker for woods 44 and/or a heel marker for irons 46. Once again, the process by which the golfer moves club selection bar 18 side to side to appropriately indicate the golfer's stance and the placement of the ball is described in more detail below.

Figure 3B:
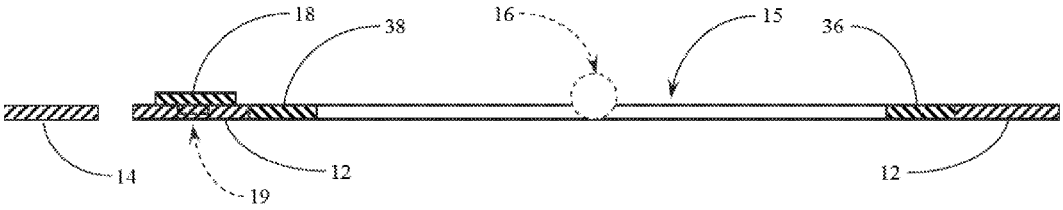
FIG. 3B is a cross sectional view of an embodiment of the golf swing training device of the present invention viewed along section lines B-B in FIG. 1.

FIGS. 3A-3B are partial cross-sectional views of an embodiment of the template frame 12, club selection bar 18 (in the case of FIG. 3A), and golfer stance template 14 (in the case of FIG. 3B). FIG. 3A shows the manner in which club selection bar 18 retains selection bar slot tabs 19*a* & 19*b* which fit into and slide within selection bar slots 20*a* & 20*b*. FIG. 3B is a partial cross-sectional view on a section line orthogonal to the view of FIG. 3A showing the upper and lower frame elements of template frame 12 with ball 16 positioned in the middle of framed space 15. Shown positioned at a spaced distance from template frame 12 is golfer stance template 14. In this particular embodiment the golfer stance template 14 will not be attached to the template frame but an additional variable length connector may be used that will attach to the golfer stance template 14 using a slide slot on the additional connector and a tab piece on the golfer stance template 14 to variably adjust the separation distance (similar to the manner in which the club face alignment tabs are structured). FIG. 3B also shows club selection bar 18 positioned on template frame 12 utilizing selection bar slot tabs 19 to retain its position thereon. Also shown within framed space 15 are upper club space alignment tab 36 and lower club face alignment tab 38, which may be separately attachable to the frame 12, and removable in some embodiments, or may be integrally formed with the frame.

Figure 20:
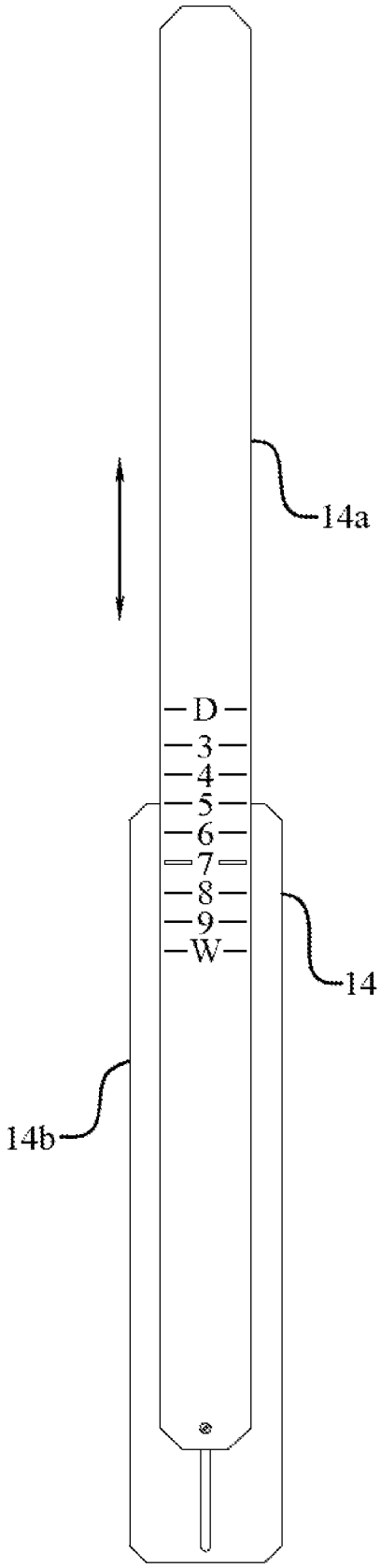
FIG. 20 is a detailed top plan view of an embodiment of the golfer stance template of the present invention.

In the embodiment of FIG. 20, the golfer stance template 14 includes a stationary portion 14*b* and a movable portion 14*a*. In this embodiment an end of the stationary portion 14*b* is positioned adjacent to, or abutting, the frame 12, preferably in-line with the club face alignment tab. The movable portion 14*a* is slid in closer to, or further from, the frame 12 in a direction perpendicular to the long axis of the frame 12, and the movable portion 14*a* is releasably secured in place once the user has achieved their preferred setback distance for a particular club; then the other indicia on the golfer stance template 14 serves as a guide to the user regarding proper setback distance for other clubs. The components may be releasably secured together in any number of ways including, but not limited to, quick-release interlock devices such as wing-nuts and quarter turn locks. The interaction between the stationary portion 14*b* and the movable portion 14*a* may be achieved in any of the manners described herein with respect to the club selector bar 18 and the template frame 12.

Figure 4A:
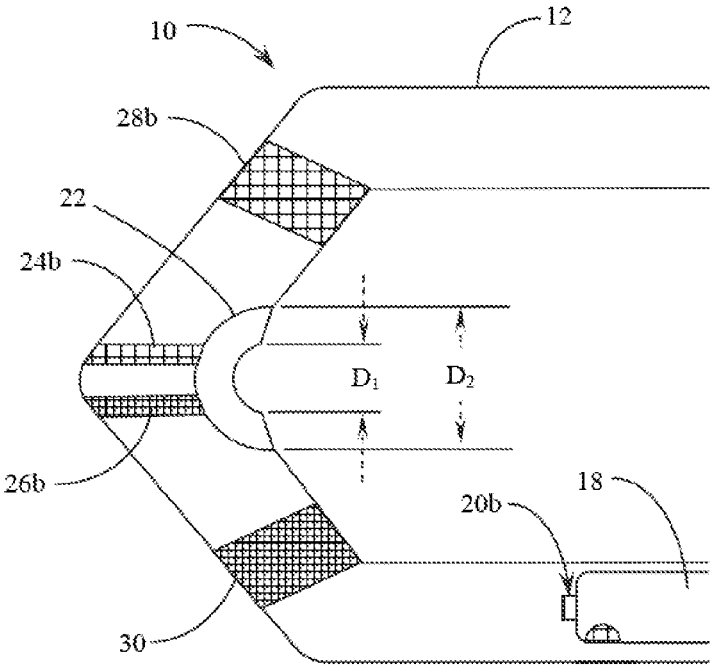
FIG. 4A is a detailed top plan view of an embodiment of the target arrow portion of the golf swing training device of the present invention.
Figure 4B:
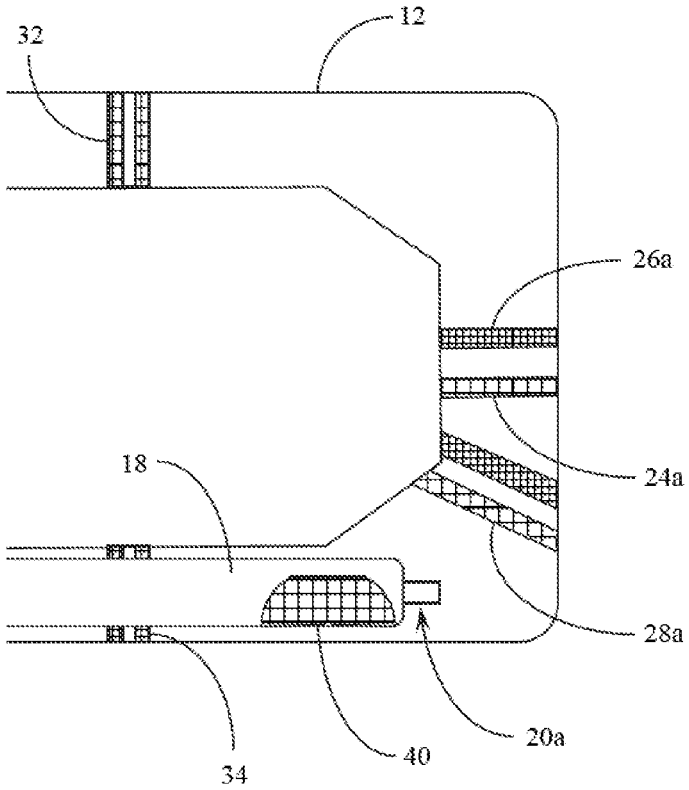
FIG. 4B is a detailed top plan view of an embodiment of the back swing portion of the golf swing training device of the present invention.
Figure 13:
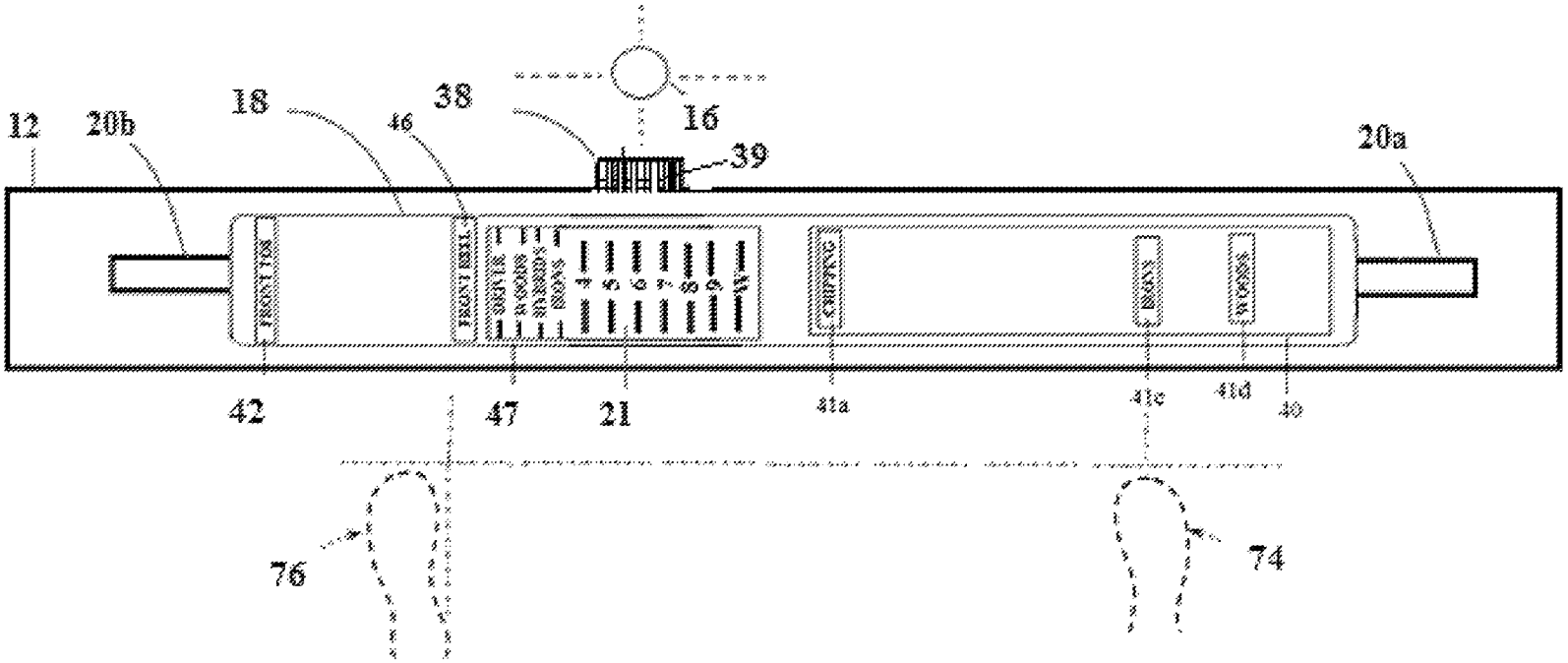
FIG. 13 is a detailed top plan view of an embodiment of the golf swing training device of the present invention.
Figure 23:
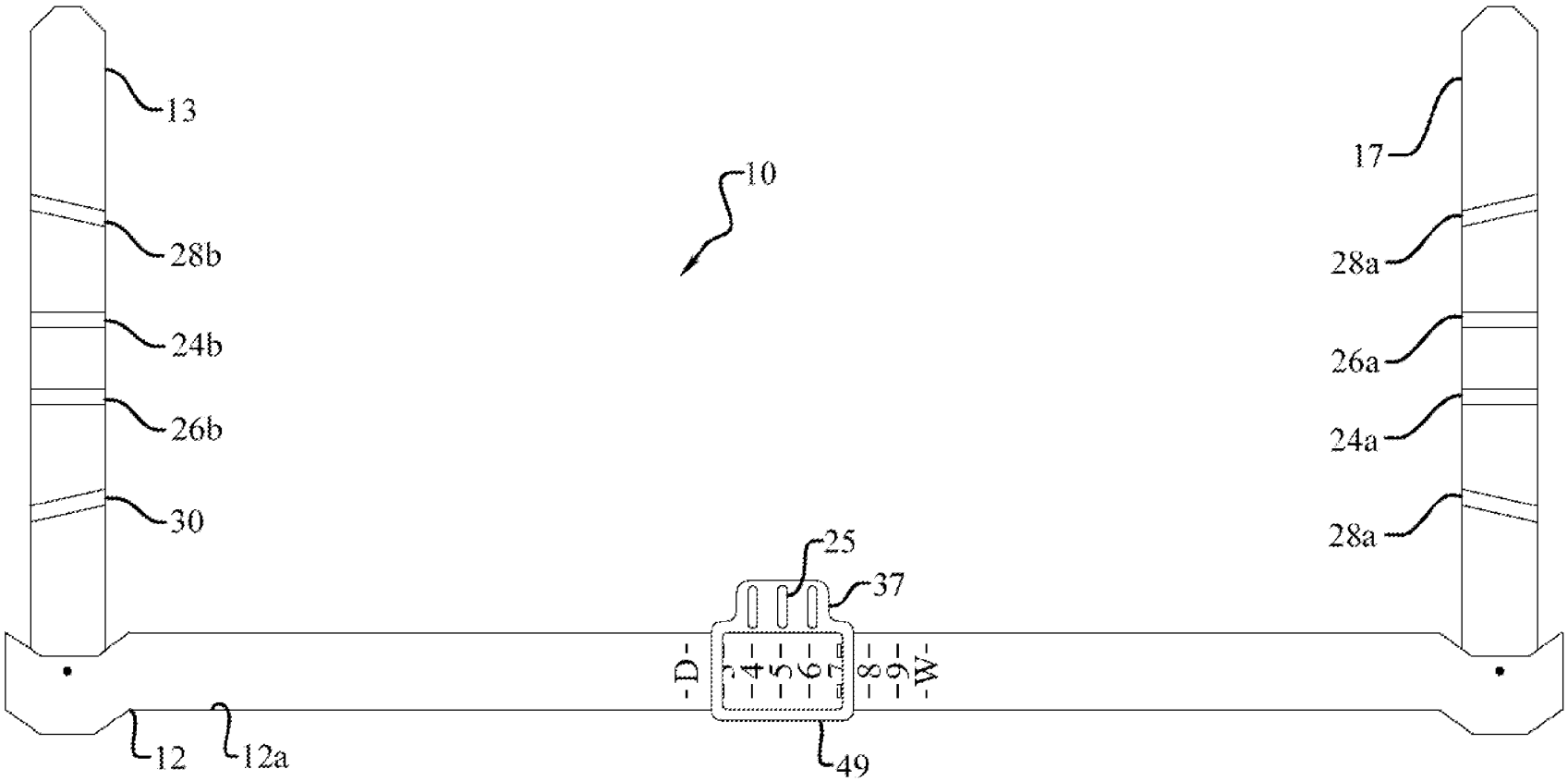
FIG. 23 is a detailed top plan view of an embodiment of the golf swing training device of the present invention.

Reference is next made to FIGS. 4A & 4B for a detailed description of the embodiments having a target arrow portion of the golf swing training device (FIG. 4A) and/or the backswing portion of the golf swing training device (FIG. 4B). In each of these views template frame 12 is shown once again to be an open frame of flexible or rigid sheet material, unitary or multipart, that is placed on the ground around the ball with an orientation towards the target, however it should be noted that the frame 12 need not totally enclose the hitting area a full 360 degrees. In one particular embodiment the frame 12 encloses at least 180 degrees of the hitting area, while in a further embodiment, such as that seen in FIG. 21, the frame 12 encloses 270 degrees of the hitting area when the forward swing path guide 13 and the rearward swing path guide 17 are perpendicular to the primary longitudinal frame section 12*a* that cooperates with the club selection bar 18 or the slider tab 37, as seen in FIG. 23. In an even further embodiment, such as that seen in FIG. 15, the frame 12 includes a secondary longitudinal frame section 12*b* and totally encloses the hitting area, and both the primary longitudinal frame section 12*a* and the secondary longitudinal frame section 12*b* cooperate with the club selection bar 18 or the slider tab 37. In fact, the primary longitudinal frame section 12*a* and/or the secondary longitudinal frame section 12*b* may be independently used with the club selection bar 18, as seen in FIG. 13.

Figure 21:
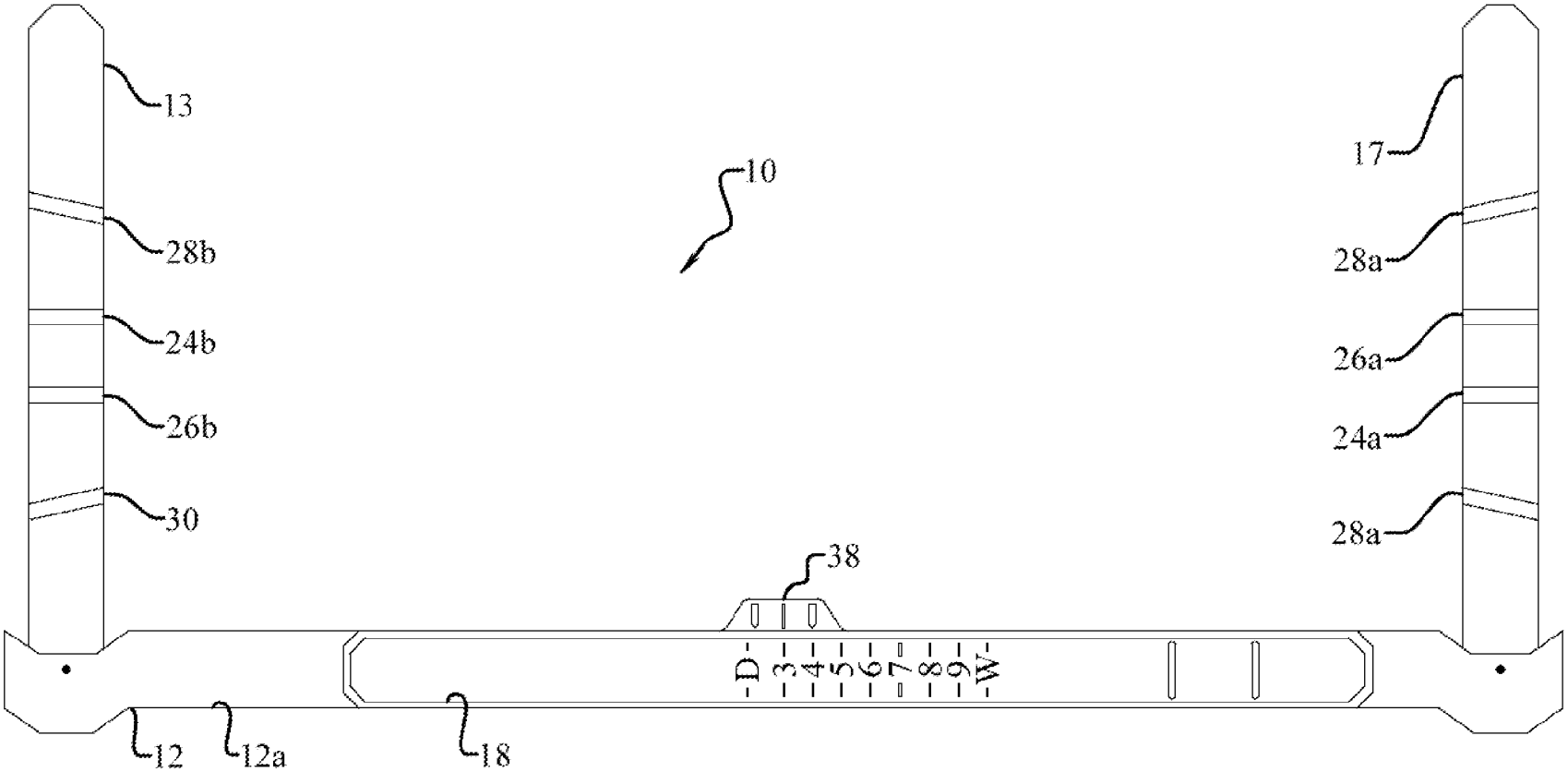
FIG. 21 is a detailed top plan view of an embodiment of the golf swing training device of the present invention.
Figure 22:
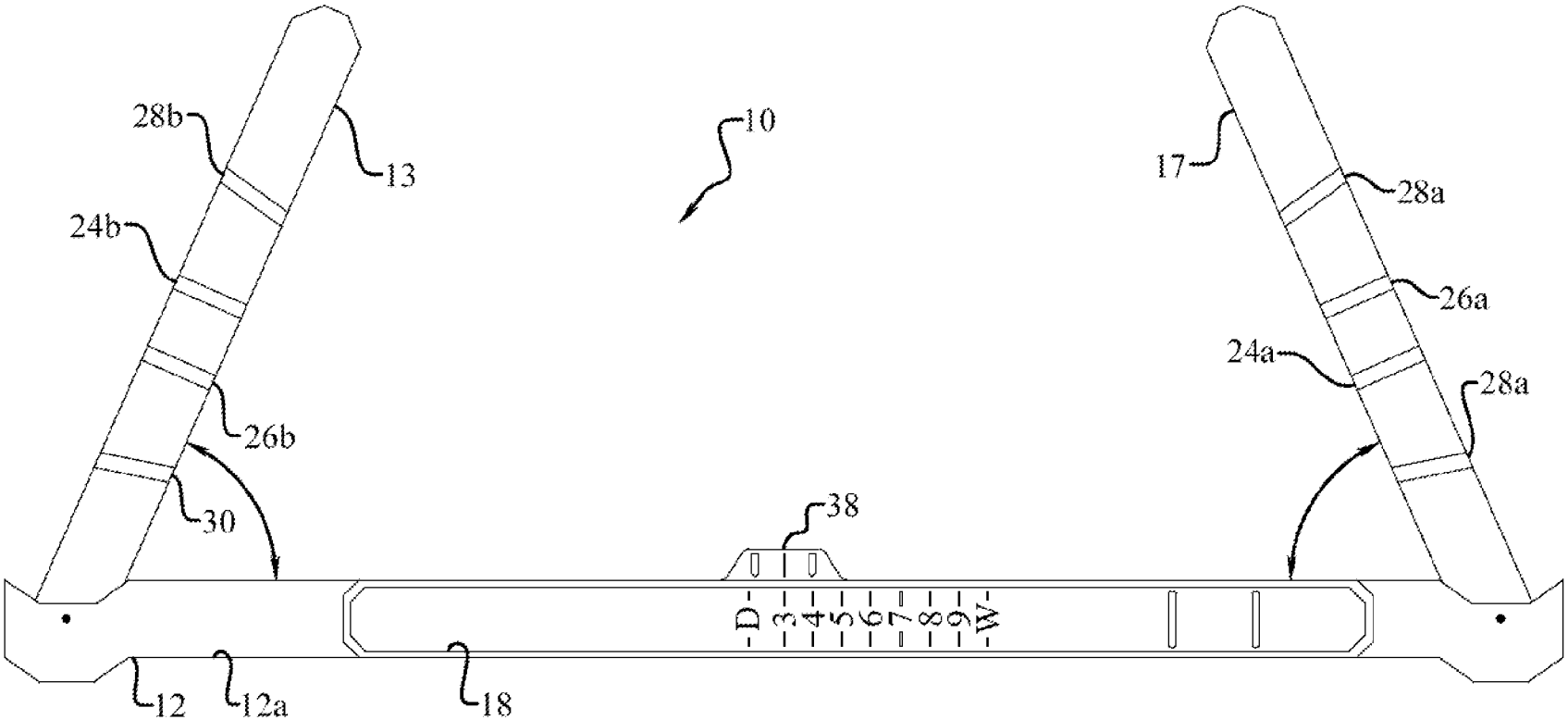
FIG. 22 is a detailed top plan view of an embodiment of the golf swing training device of the present invention.

As seen in FIGS. 21 and 22, the forward swing path guide 13 and the rearward swing path guide 17 may be rotationally attached at opposite ends of the primary longitudinal frame section 12*a* so that the guides 13, 17 may be conveniently stored parallel to, and underneath, the primary longitudinal frame section 12*a*. In one particularly compact embodiment the guides 13, 17 each have a thickness of less than ⅜", the primary longitudinal frame section 12*a* has a thickness of less than ⅜", and the club selection bar 18 or the slider tab 37 do not project from the primary longitudinal frame section 12*a* a distance greater than ⅜"; therefore in this embodiment the storage thickness is less than 1.5", with a width of less than 8" and a length of less than 48". In an even further embodiment the storage thickness is less than 1.0", with a width of less than 4" and a length of less than 42". In a preferred embodiment at least one of the guides 13 or 17 rotates at least 90 degrees with respect to the primary longitudinal frame section 12*a*, while in a further embodiment both the guides 13 and 17 rotate at least 90 degrees with respect to the primary longitudinal frame section 12*a*; while in an even further embodiment at least one of the guides 13 or 17 automatically locks in place once it is rotated to a predetermined operating position, and may be easily released from the operating position by operating a locking pin or latch system.

Referring back to FIG. 4A, in one embodiment the front portion of golf training template 10, generally comprising the forward-oriented ⅛ to ½ of template frame 12, presents an overall arrow configuration to the golfer for easy orientation of the template and of the golfer's swing and shot. Alternatively, in another embodiment the forward portion of the template frame 12 is a forward swing path guide 13, such as that seen in FIG. 21, that is configured as a straight section rather than an arrow configuration, as is the rearward swing path guide 17, also seen in FIG. 21. A portion of club selection bar 18 positioned within bar slot 20*b* is also seen in FIG. 4A. The indicia associated with the forward portion of the template frame 12 may again include target line marker 24*b* (blue in one embodiment) and/or target line marker 26*b* (red in one embodiment). Thus, one embodiment includes at least two forward target line markers 24*b* and 26*b* of differing colors, and in a further embodiment they are parallel to each other. Because the golfer's swing seldom involves a straight line motion because of its pivoting nature, an additional embodiment includes indicia for swing path draw shots 28*b* and swing path fade shots 30, which in one embodiment are at least 5 degrees from the orientation of the target line markers 24*b* and 26*b*, and in another embodiment are at least 10 degrees from the orientation of the target line markers 24*b* and 26*b*. The manner in which these swing path markers are used is described in more detail below.

In addition to the normal swing training functions and the indicia related thereto shown in FIG. 4A, template frame 12 may also include a putting target configured as cup cutout target 22. In the one embodiment cup target cutout 22 is a two-part target presenting two diameters of the target to the golfer for putting practice. Diameter D1 would typically equal the approximate diameter of a golf ball while diameter D2 would preferably represent the typical diameter of a cup or hole on a golf course, thus in one embodiment D1 is less than 50% of D2, while in an even further embodiment D1 is at least 60% less than D2. In this manner a golfer may practice with the narrowest target attempting to get the golf ball within the smaller diameter D1 but would recognize that striking the ball within the larger D2 would likely accomplish putting into the hole or cup in the real play of the game.

FIG. 4B shows the trailing portion of template frame 12 in one embodiment for swing training device 10 and likewise discloses a portion of club selection bar 18. In the view of FIG. 4B the back foot marker 40 is seen positioned near the trailing end of club selection bar 18. In a further embodiment, positioned directly on template frame 12 are further indicia that the golfer may use for a backswing either in putting practice or with the swing training process. Target line markers 24*a* & 26*a* are shown as in line with the orientation of the overall template towards the target. Thus, one embodiment includes at least two rearward target line markers 24*a* and 26*a* of differing colors, and in a further embodiment they are parallel to each other. A further embodiment includes at least one forward target line marker 24*b* and at least one rearward line marker 24*a*, which in a further embodiment are parallel to each other, and in yet an even further embodiment are aligned with each other. Another embodiment includes a swing path backswing marker 28*a* that provides the typical path of a backswing for most swinging shots, and a further embodiment seen in FIG. 21 incorporates a second swing path backswing marker 28*a* on the opposite side of the target line markers 24*a* and 26*a* to accommodate left-handed users. In the embodiment of FIG. 4B the swing path backswing marker 28*a* is illustrated as multiple parallel lines, however the embodiment of FIG. 21 illustrates that each swing path backswing marker 28*a* may consist of a single line. Also shown in FIG. 4B, another embodiment includes one, or both, of an upper putter alignment strips 32 and lower putter alignment strips 34, which, as mentioned above in combination with target line markers 24*a* & 26*a*, provide the crosshair "bull's-eye" to position and aim at the ball for purposes of putting practice.

Figure 5:
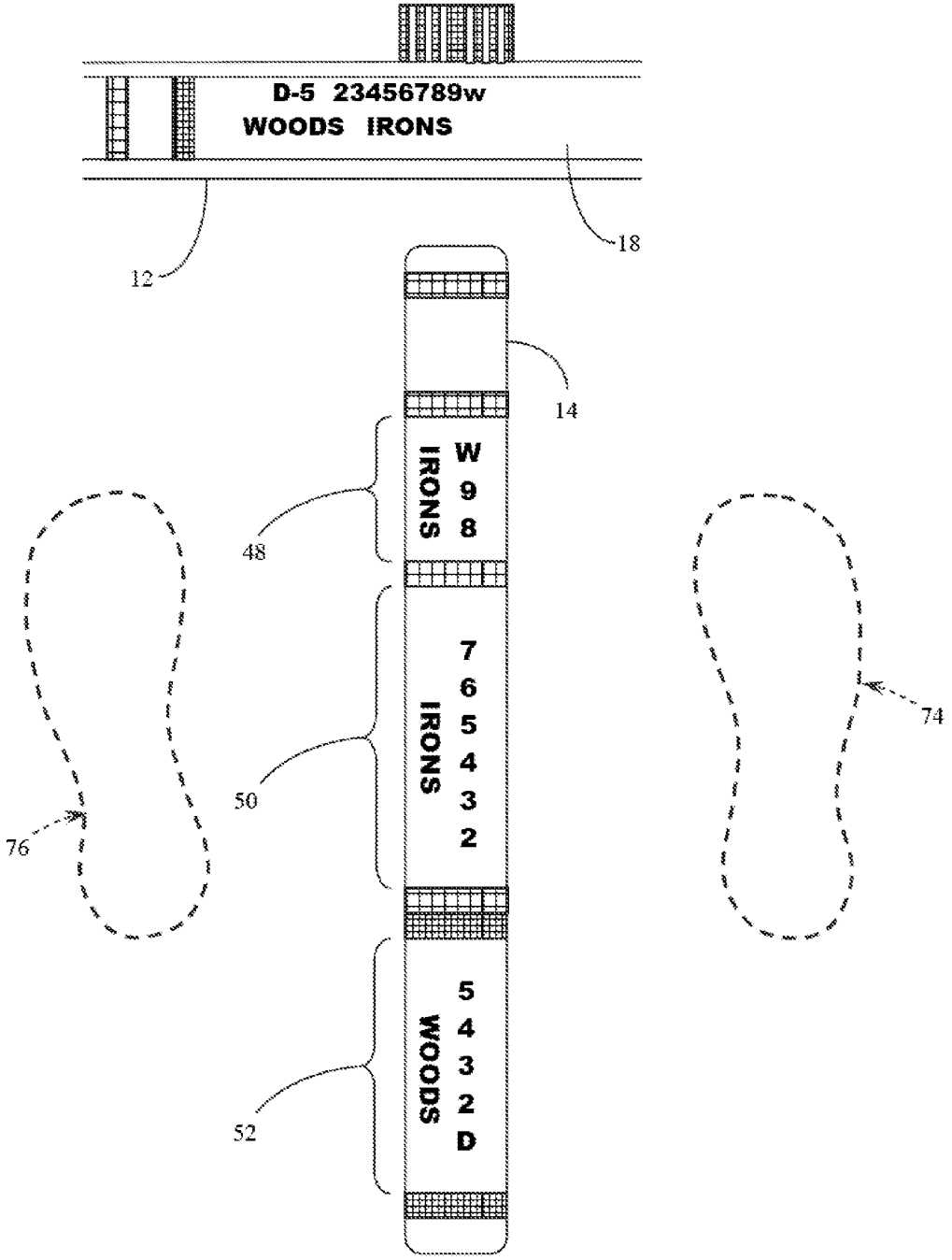
FIG. 5 is a detailed top plan view of an embodiment of the golfer stance portion of the golf swing training device of the present invention.

Reference is next made to FIG. 5 for a detailed description of a top plan view of the golfer's stance template 14 of an embodiment of the golf swing training device of the present invention. In this view a small portion of template frame 12 is disclosed where golfer's stance template 14 is positioned adjacent the template frame 12. Club selection bar 18 is shown slidably positioned on top of template frame 12. In this embodiment the golfer stance template 14 is a long narrow rectangular extension optionally placed at a spaced distance (as described above) to template frame 12 and is intended to provide the golfer with the preferable placement of the golfer's feet 74 & 76 in terms of distance from the ball. This distance is of course determined in part by the club selection which determines the placement of the indicia on golfer stance template 14 at varying distances from where the ball would be placed within template frame 12. In one embodiment the club indicia 48, 50, 52 may be grouped into at least three groups, the first being the scoring club indicia 48, or short iron indicia, reflecting the setback distance for at least two clubs from the group of an 8-iron, 9-iron, and wedge. A further embodiment includes indicia associated with at least three clubs within this group, namely the 8-iron, 9-iron, and wedge, which provide the greatest loft with the shortest distance and generally require the golfer to stand closer to the ball when swinging. The intermediate group club indicia 50 may comprise the bulk of the irons that a golfer might use from a 2-iron through to a 7-iron, and one embodiment of this group includes indicia associated with at least three clubs within this group. Again, insofar as the numbering of the irons is an indication of the angle of the club face and therefore the loft directed to the ball, the less loft the further back the golfer should stand. Finally, the group identified by wood indicia 52 provides a typical setback distance range for drivers and/or woods from a standard driver through a 5-wood. One embodiment of this group includes indicia for at least a driver and at least one additional wood club. Although there is typically some overlap in the angle of the club face between woods and irons the use of a wood generally results in less loft and greater distance. More importantly, the golfer must position themselves further from the ball because the clubs get longer as they progress through the woods and drivers. In one particular embodiment the spacing between the indicia in one of the three groups is different from the spacing between the indicia in one of the other three groups. For instance, in one embodiment the spacing between the scoring club indicia 48 is different from the spacing between the wood indicia 52.

The dashed outline shapes representing the golfer's feet 74 & 76 shown in FIG. 5 are placed at a distance that might be appropriate when the golfer is using an 8-iron, a 9-iron or a wedge. Strict alignment (as shown further in FIG. 6) might be appropriate for use of the 9-iron such as where the golfer might be chipping out of the rough or some other short-distance high-loft shot.

Figure 6:
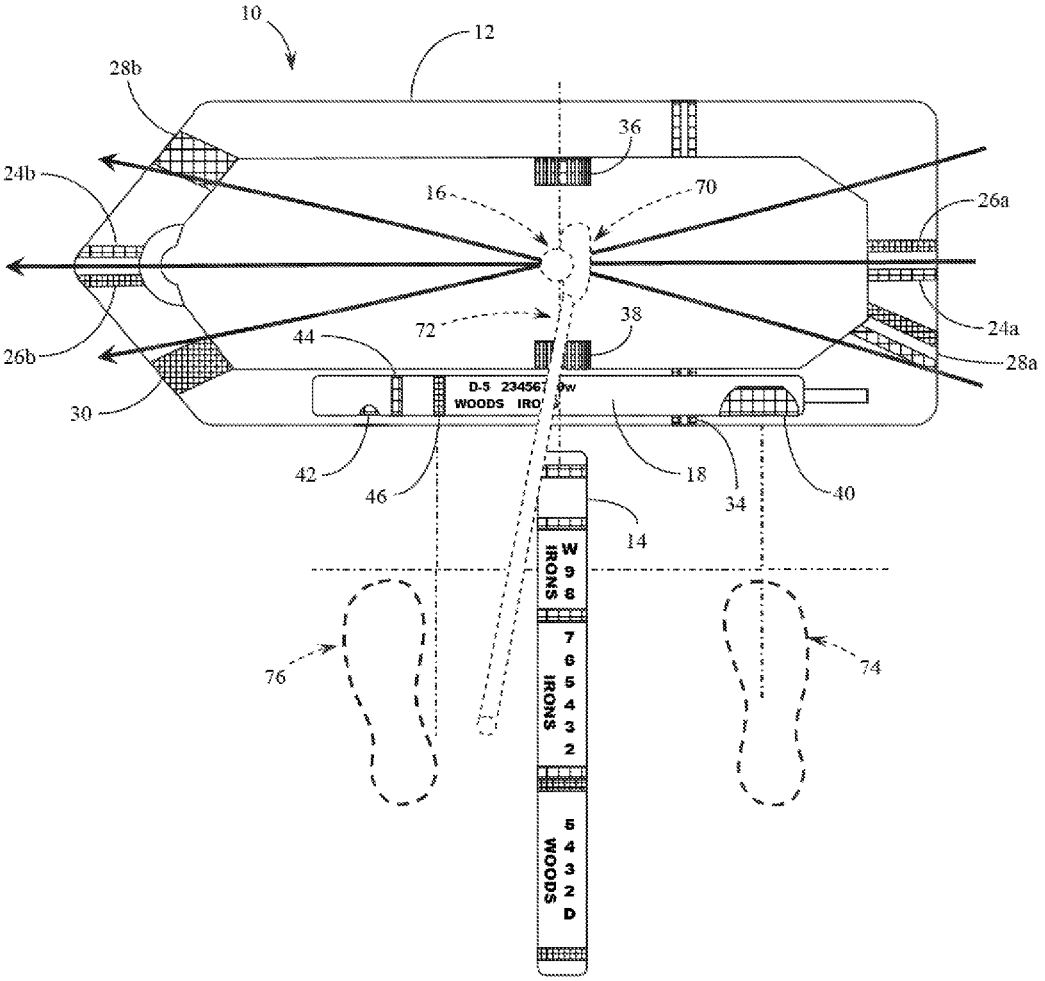
FIG. 6 is a top plan view of an embodiment of the golf swing training device of the present invention in use with a nine iron.

FIG. 6 provides in greater detail the placement of the golfer's feet on either side of golfer stance template 14 showing, in addition to the distance from the ball, the proper placement of the golfer's stance (side to side) utilizing the club selection bar 18, back foot marker 40, and lead foot marker 42. Although the actual method of use of the template is described in greater detail below, the placement and positioning shown in FIG. 6 might be appropriate for use of the template with a 9-iron in the manner described above. With a 9-iron selected, the golfer has moved club selection bar 18 towards the left in the view shown, which places back foot marker 40 and lead foot marker 42 towards the left and thereby places the ball more in the center of the golfer's stance. The swing paths shown in FIG. 6 for both a straight and a draw shot will be controlled by the golfer by directing their backswing across the appropriate indicia on template frame 12 as shown. The view of FIG. 6 superimposes a typical club 72 (a 9-iron in this example) with club face 70 positioned adjacent ball 16 in a crosshairs target alignment utilizing club face alignment tabs 36 & 38.

Figure 7:
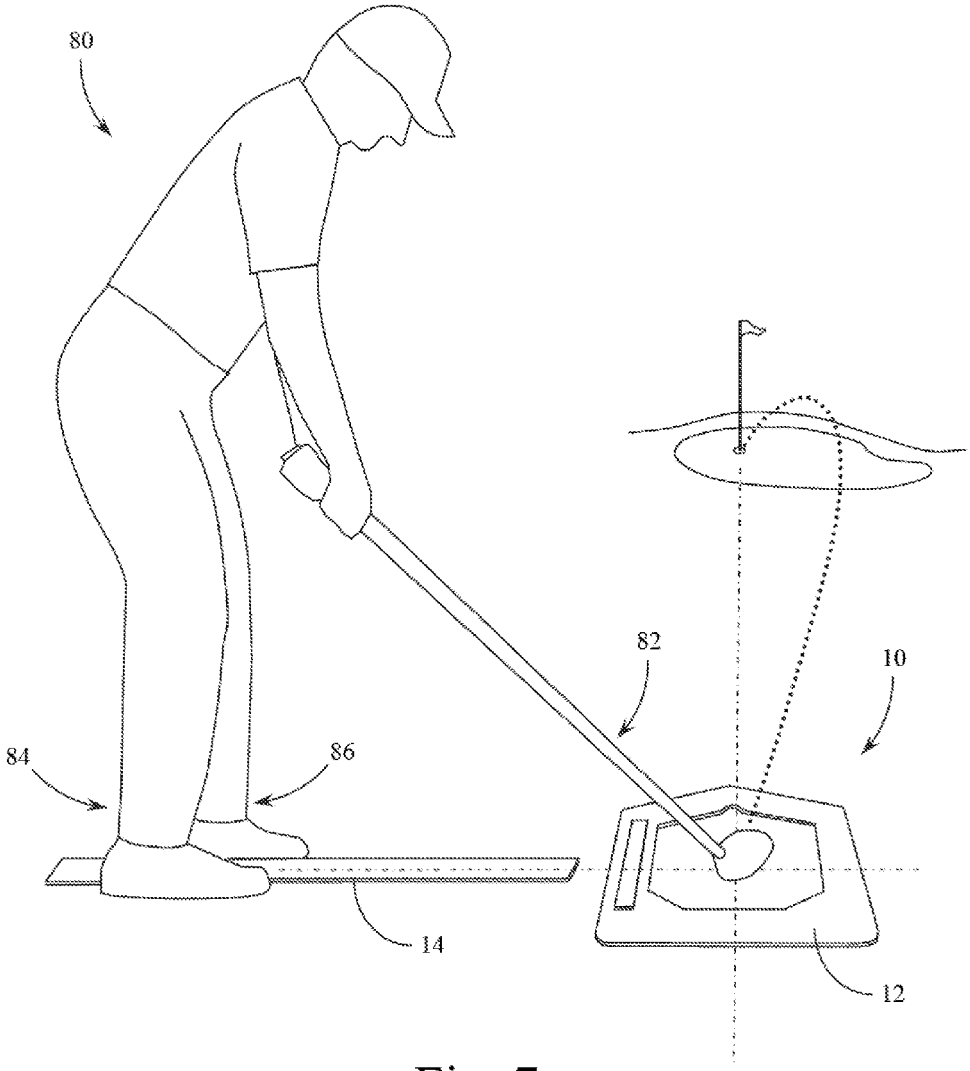
FIG. 7 is a perspective view of an embodiment of the golf swing training device of the present invention in use by a golfer directed towards a target hole.

Reference is next made to FIG. 7 which shows a golfer positioned in association with golf training template 10 of the present invention with the ball and the club head positioned within the open space framed by template frame 12. Golfer stance template 14 extends away from template frame 12 between the golfer's legs 84 & 86. Golfer 80 holds club 82 and swings to hit the ball (not seen in this view) towards the target by utilizing the crosshair sighting alignment system provided by the template of the present invention.

Figure 8A:
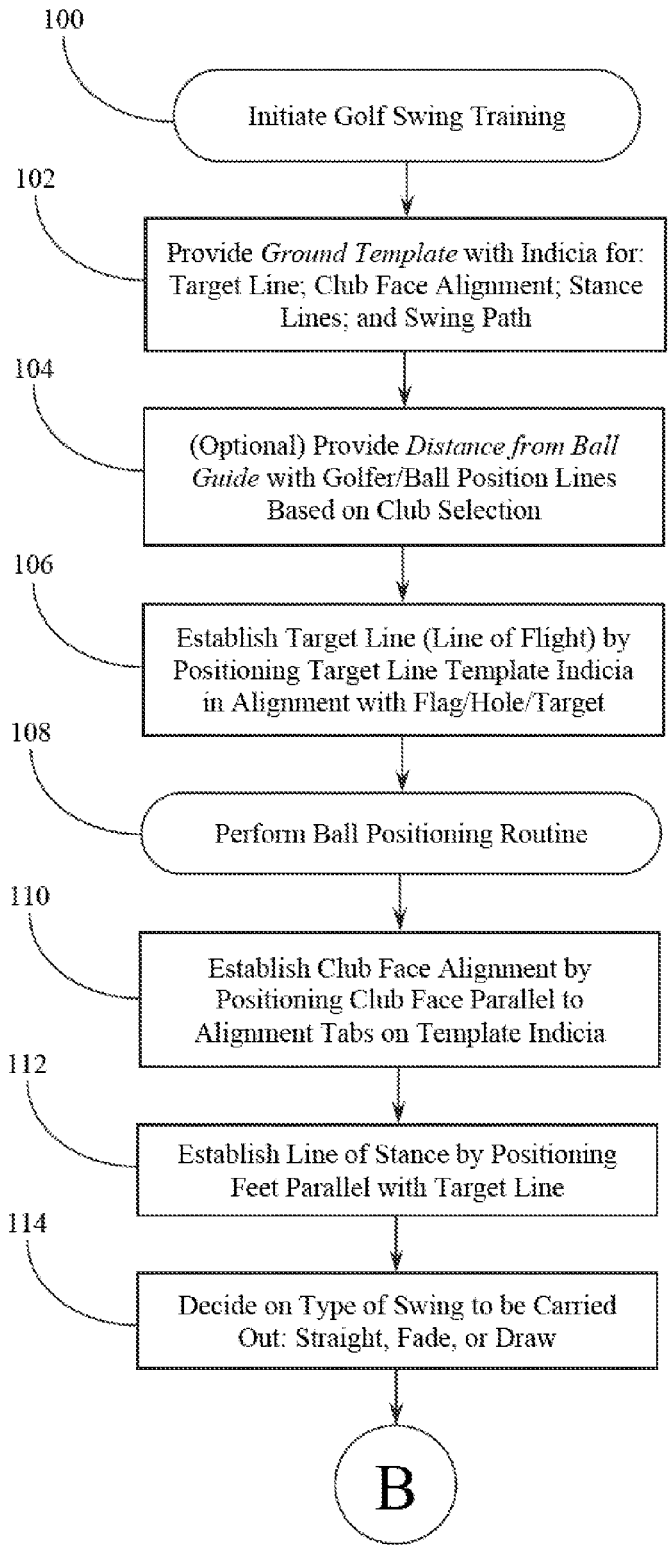
FIGS. 8A-8C provide flowcharts showing the top level method of using various embodiments of the golf swing training device of the present invention.
Figure 8B:
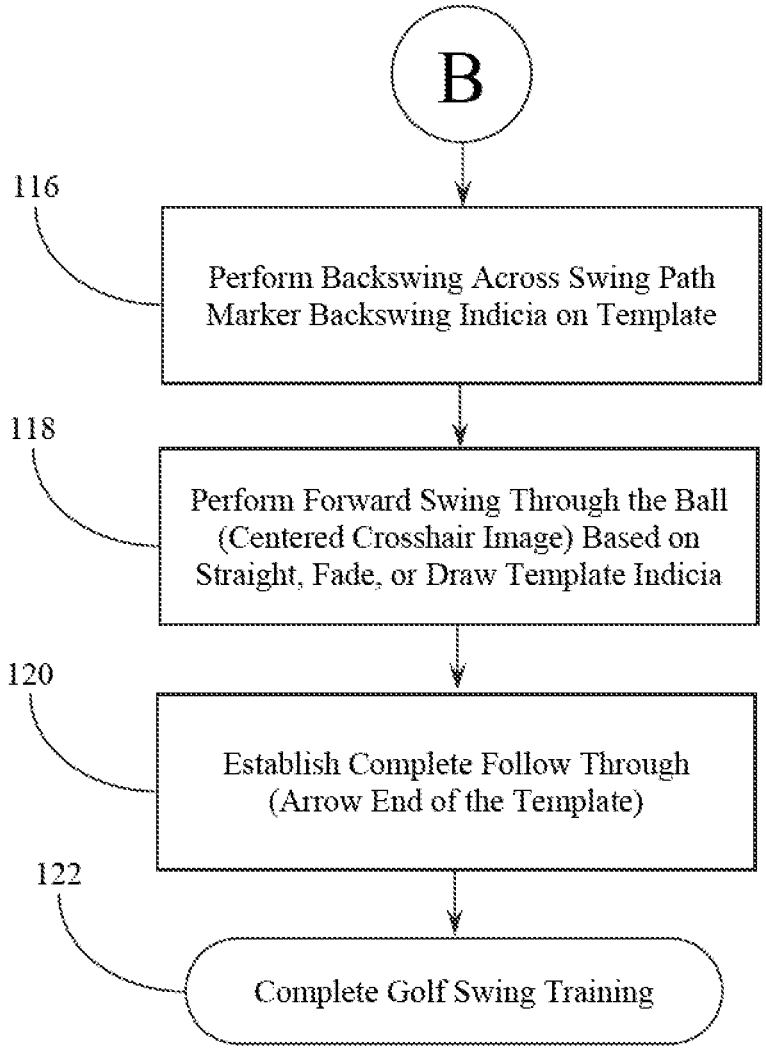
Figure 8C:
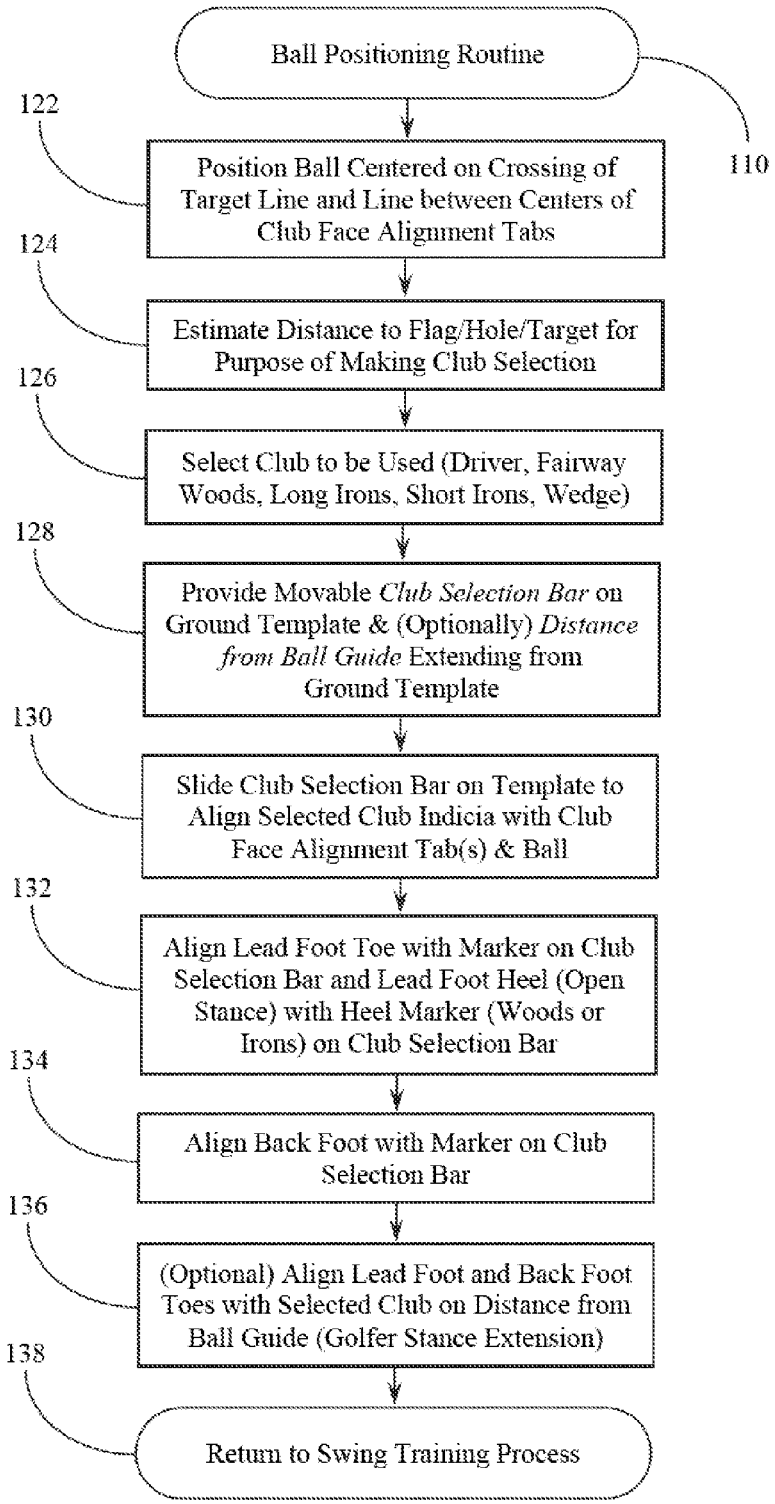

Reference is next made to FIGS. 8A-8C for a description of the basic method of utilizing an embodiment of the training template of the present invention. FIGS. 8A & 8B provide the primary process path for utilizing the swing training device, while FIG. 8C represents what is essentially a subroutine of the process wherein the golfer positions the feet and modifies the template based upon club selection. Beginning in FIG. 8A the golfer initiates the golf swing training at Step 100. The first few steps in the process, proceeding to Step 102 involve providing the ground template with the indicia suitable for showing a target line; club face alignment; a stance line; ball position; and the respective swing paths. Step 104 may be considered as an optional step that involves providing the distance from the ball guide that extends from the ground template as described above. Initially the golfer establishes the target line at Step 106 that will represent the line of flight of the ball, by positioning the target line template indicia in alignment with the flag or hole as the target. Once in this general configuration the golfer carries out the ball positioning routine at Step 108 that depends upon club selection, which itself depends upon distance to the target. Once the golfer has performed the ball positioning routine at Step 108 and returns to the main swing training process at Step 110 the golfer establishes club face alignment by positioning the club face parallel to the alignment tabs on the template. Next at Step 112, the golfer establishes a line of stance by positioning his or her feet parallel with the target line. At Step 114 the golfer decides on the type of swing to be carried out. The manner of swing will depend on whether the golfer anticipates that a straight shot, a fade shot, or a draw shot is the preferable shot to direct the ball towards the target. Again, this decision is carried out at Step 114 before proceeding further with the primary process path.

Referencing through Connector B to FIG. 8B the golfer then performs, at Step 116, a backswing with the club across the swing path marker backswing indicator. The golfer then, at Step 118, performs a forward swing through the ball that is centered on the crosshair image created by the template based again on straight, fade, or draw shot template indicia on the ground template. Finally the golfer establishes the appropriate follow through across the arrow end of the template at Step 120 and thereby completes the golf swing training process at Step 122.

Reference is finally made to FIG. 8C for a detailed description of the Ball (and stance) positioning routine that is carried out based in part on club selection. Ball positioning routine (Step 110) begins at Step 122 where the golfer positions the ball centered on crossing of the target line and the line between the centers of the club face alignment tabs. At Step 124 the golfer estimates a distance to flag/hole/target for the purpose of making a club selection and at Step 126 selects the club to be used (driver, fairway wood, long iron, short iron, wedge).

Returning to the important template structure at Step 128 the process includes providing the movable club selection bar on the ground template and (optionally) the distance from ball guide extending from a position adjacent the ground template. At Step 130 the golfer slides the slide club selection bar on the template to align the selected club indicia with the club face alignment tab(s) and the ball. Still focusing on the sliding club selection bar, at Step 132 the golfer aligns his lead foot with the appropriate marker on the club selection bar, which in one embodiment may include a lead foot toe marker and/or a lead foot heel marker. An embodiment with both the toe marker and heel marker reinforces to the user that an open lead foot position is desirable in some situations and promotes proper hip rotations. This is followed at Step 134 with an alignment of the golfer's back foot with the appropriate marker on the club selection bar.

If the golfer stance template 14 is being used then the golfer continues at Step 136 to align his lead foot and back foot toes with the selected club indicia on the golfer stance template 14. This concludes the ball positioning routine where after the golfer returns to the primary swing training process at Step 138 and completes that process as described above.

Figure 9:
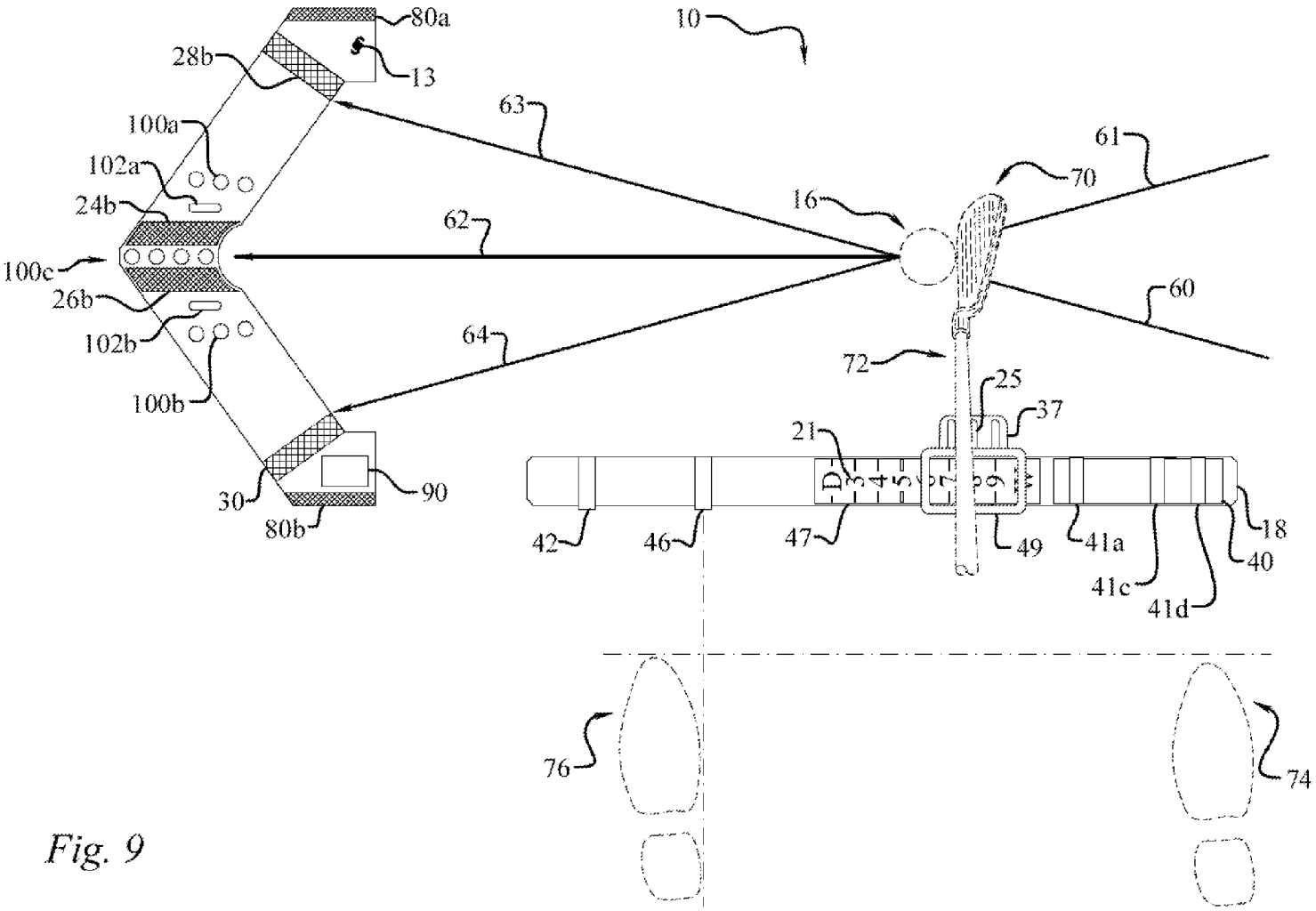
FIG. 9 is a detailed top plan view of an embodiment of the golf swing training device of the present invention.

Reference is made next to FIGS. 9, 10, 11, 19, and 25 which illustrate a top plan view of another embodiment of the golf swing training device 10 of the present invention incorporating a slider tab 37. In this embodiment the golf training device 10 is constructed primarily of the forward swing path guide 13 and the club selection bar 18. A golf ball 16, a golf club 72, and the face of the golf club 70 are shown in FIG. 9 for reference. Additionally, positioned on the club selection bar 18, is the club face alignment slider tab 37 which is a rectangular component having a club face alignment window 49 through which the golfer may view the club indicia 21 when the club face alignment slider tab 37 is placed on top of and slides on the club selection bar 18, or in the embodiment of FIG. 25 when the slider tab 37 is placed on top of and slides on a portion of the mat 150. When being used by a left handed golfer, the club selection bar 18 is placed on the ground on the opposite side of the forward swing path guide 13 with the club face alignment indicia 25 of the club face alignment slider tab 37 facing the golf ball. The slider tab 37 may slidably cooperate with the club selection bar 18 in any of the previously disclosed manners with respect to the club selection bar 18 and a portion of the template frame 12. Further, in one embodiment at least a portion of the slider tab 37 engages an edge of the club selection bar 18, or in yet a further embodiment the slider tab 37 engages at least two edges of the club selection bar 18. The slider tab 37 may wrap around the edge of the club selection bar 18, however it may also engage a slot formed in one or more of the side walls of the club selection bar 18.

Figure 11:
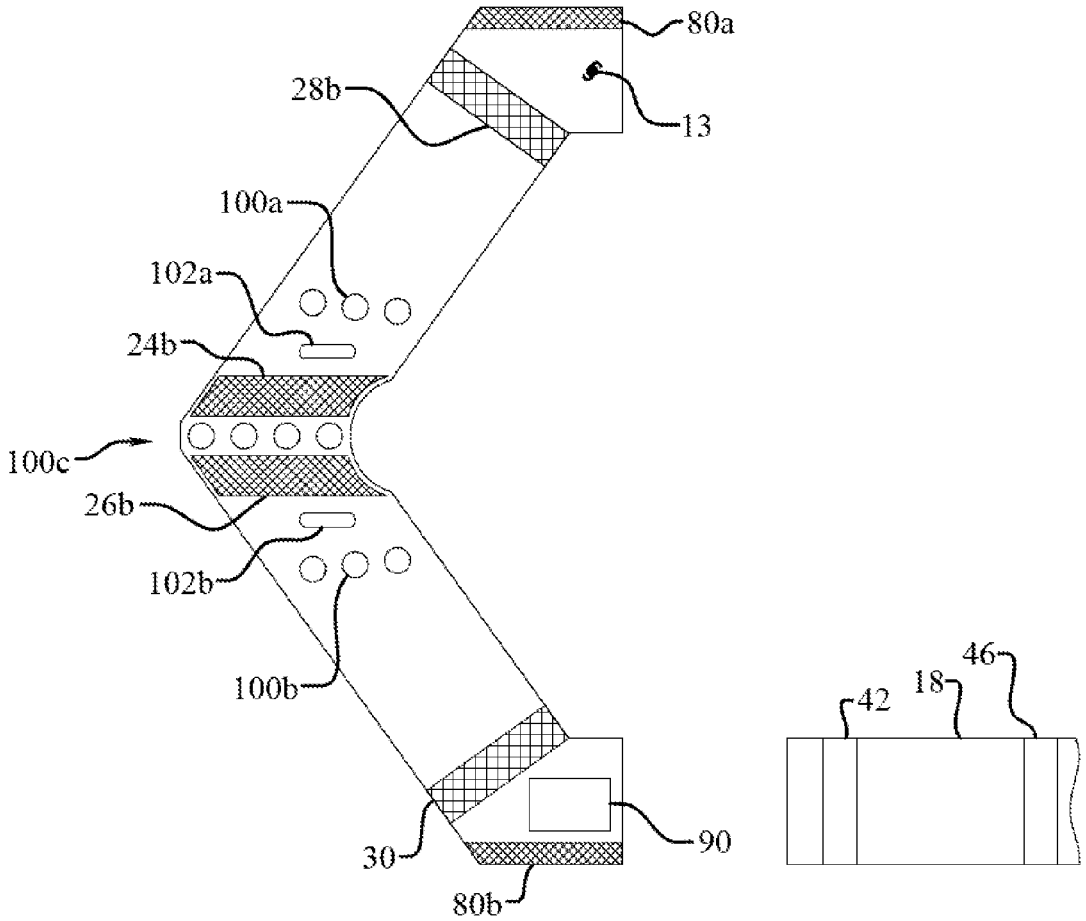
FIG. 11 is a detailed top plan view of an embodiment of the target arrow portion of the golf swing training device of the present invention.

In one embodiment the forward swing path guide 13, seen best in FIG. 11, is of unitary construction and generally in the shape of an arrowhead with the pointed side directed towards the target. Alternately, the forward swing path guide 13 may be constructed in two or more parts that fold or snap together. In a further alternate manner, the forward swing path guide 13 may be constructed of a flexible material that may be rolled up when not in use.

The golf trainer 10 incorporates, as indicated above, various markings and indicia that are designed to facilitate carrying out the method of the present invention. Referring again to FIG. 11, the indicia or markings on the forward swing path guide 13 may include target line markers 26*b* & 24*b*, or alternatively a single target line marker, and swing path markers 28*b* & 30. Also shown in FIG. 9 for reference are the front foot of the golfer 76 and the back foot of the golfer 74, the backswing paths 60 & 61, and forward swing paths 62, 63 & 64.

Yet a further embodiment incorporates a plurality of motion sensors 102*a* & 102*b* and motion activated lights 100*a*, 100*b*, & 100*c* to provide the user with feedback regarding whether the intended swing path was achieved. An even further embodiment incorporates a swing speed sensor and display screen for club head speed 90. Still further, another embodiment incorporates at least one and audio device to announce the swing speed and/or the swing path that was sensed.

Additional indicia visible to the golfer may be provided on club selection bar 18. In some embodiments the club selection bar 18 is of unitary construction and generally in the shape of a long narrow rectangle. Alternately, club selection bar 18 may be constructed in two or more parts that fold or snap together. In a further alternate manner, club selection bar 18 may be constructed of a flexible material that may be rolled up when not in use. The club selection bar 18 indicia may include a back foot marker area 40, which may include several indicia for the placement of the back foot for chipping 41*a*, irons 41*c*, and woods 41*d*, as seen in FIG. 9. Further indicia included on club selection bar 18 may include a front toe marker 42, a front heel marker 46, and/or a club indicia marker section 47. The club indicia marker section 47 may include club indicia 21 related to club selection and determining the lateral positioning of the club face alignment tab 37. The club face alignment tab 37 may be of unitary construction and generally in the shape of a rectangle. The club face alignment tab 37 may include club face alignment indicia 25 in the form of lines. The manner in which the golfer uses these variable components on the golf swing training device of the present invention is described in more detail below. The club selection bar 18 of embodiments such as that shown in FIG. 1, may be removed from the template frame 12 and used in conjunction with the club face alignment tab 37, as seen in FIG. 9, or the components of the embodiments of FIGS. 9 through 19 may be standalone components with no association to a template frame 12.

Figure 24:
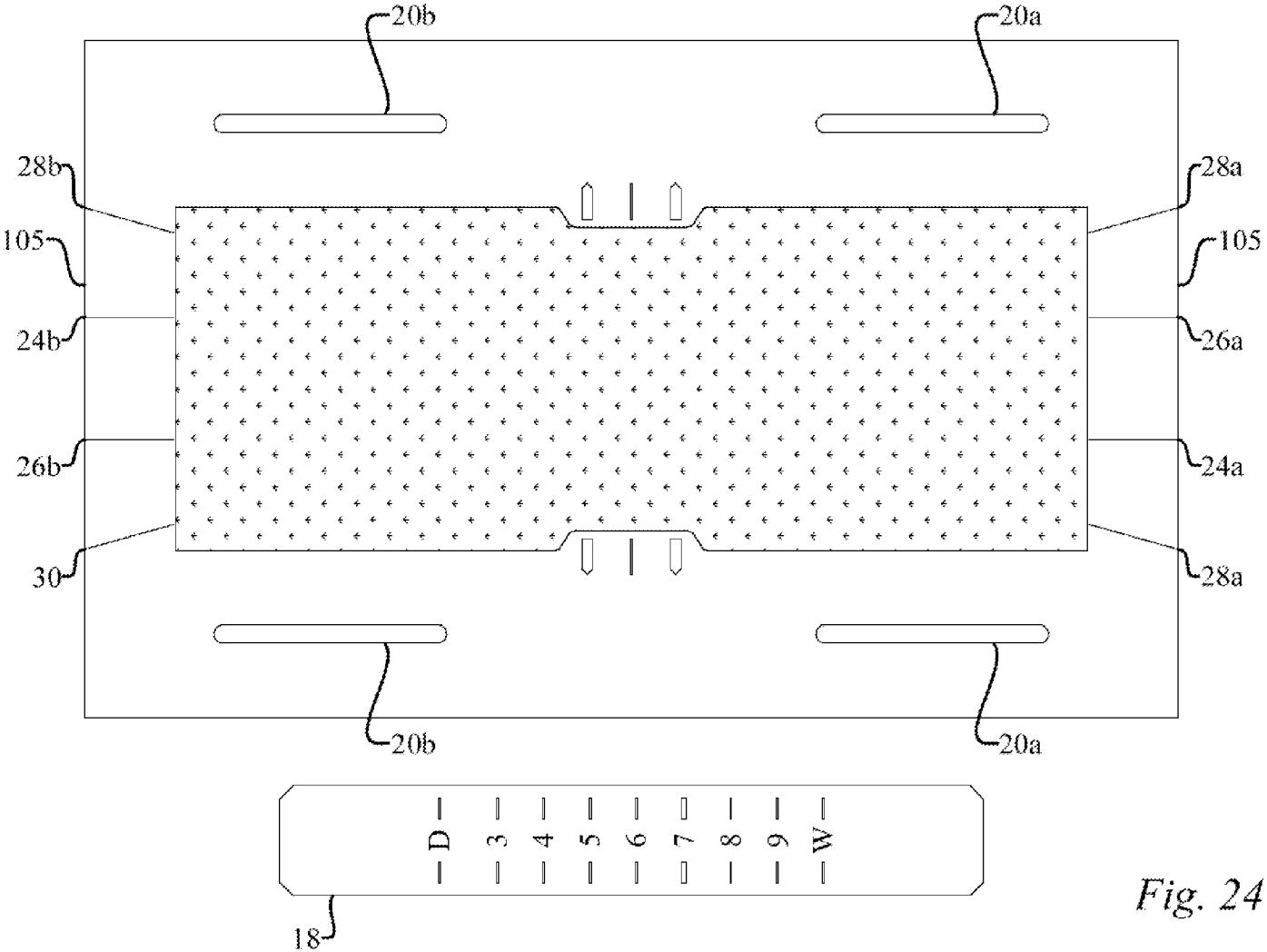
FIG. 24 is a detailed top plan view of an embodiment of the golf swing training device of the present invention.
Figure 25:
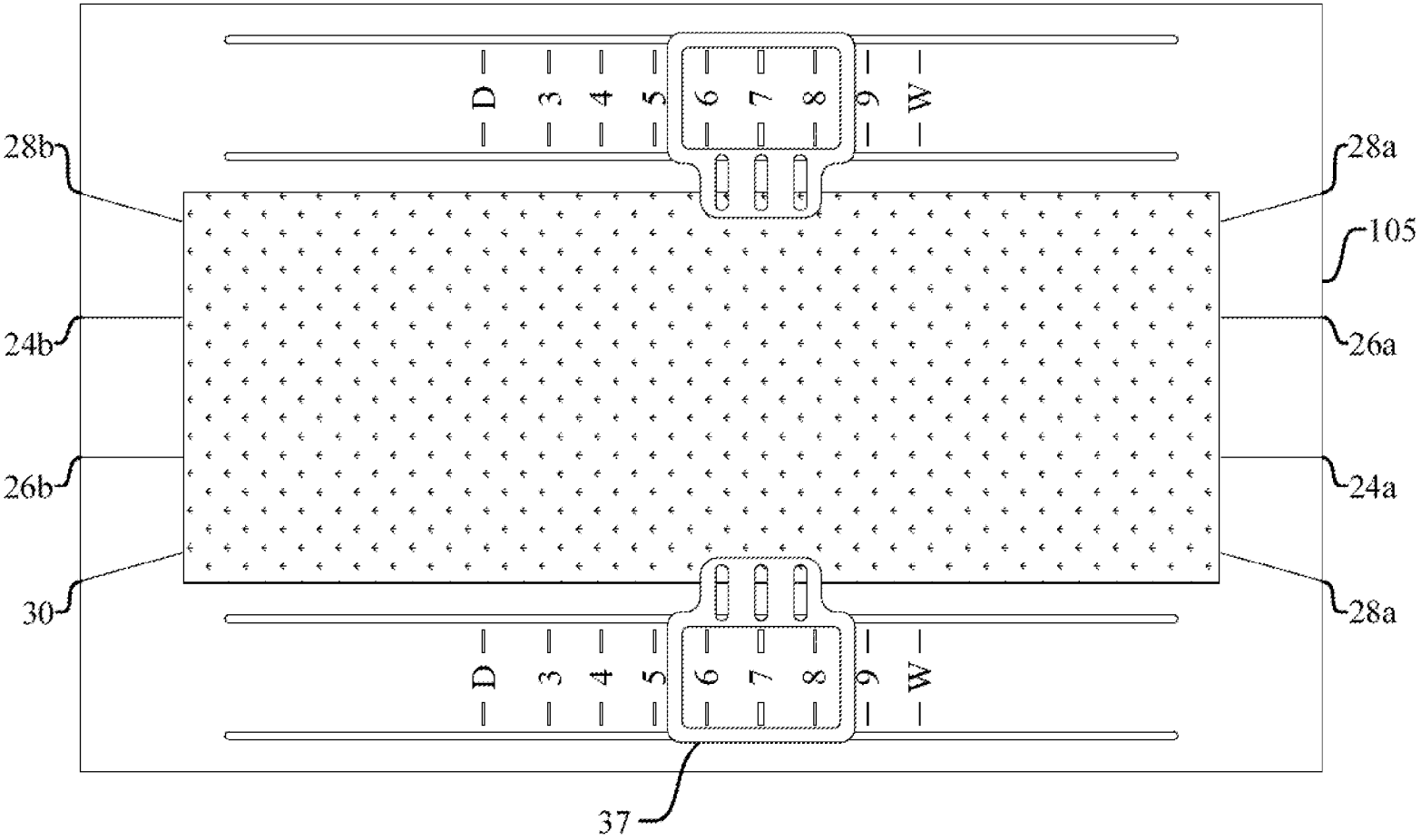
FIG. 25 is a detailed top plan view of an embodiment of the golf swing training device of the present invention.

The golf trainer 10 as shown in FIG. 9, indicates the proper placement of the golfer's stance (side to side) utilizing at least two of the following: the club selection bar 18, back foot marker section 40, front toe marker 42, and front heel marker 46. The dashed outline shapes representing the golfer's feet placement and positioning shown in FIG. 9 might be appropriate for use of the golf trainer 10 with a 8-iron in the view shown. In this view, the golfer has established a line of stance by positioning his or her feet 74 and 76 parallel with the target line and with a 8-iron selected, the golfer has moved club face alignment tab 37 into a position on club selection bar 18 where the club indicia for the 8 iron may be seen through the club face alignment window 49 on the club face alignment tab 37. This club selection process provides the golfer with a visual indicator for the placement of the feet as indicated by at least one of the back foot marker section indicia 40, front toe marker 42, and front heel marker 46. In one embodiment the swing paths shown in FIG. 9 include: path 60 for the backswing for a right handed golfer, path 61 for the backswing for a left handed golfer, and path 62 for the forward swing for a straight shot, path 63 for a fade shot for a left handed golfer and a draw shot for a right handed golfer, path 64 for a fade shot for a right handed golfer and a draw shot for a left handed golfer. A further embodiment includes one or more of these paths printed on a mat 105, or mat 150 (element number depends on figure), as seen in FIGS. 24 and 25, that may be used along with the other components; likewise in some embodiments the club indicia 21 may be printed directly on a mat 105, as seen in FIG. 25; thus, in embodiments such as FIGS. 24 and 25 the forward swing path guide 13 and/or the rearward swing path guide 17 may be a part of the mat 105 and thus not a separate and distinct piece. The golfer achieves a particular desired path by directing their forward swing across the appropriate indicia 26*b*, 24*b*, 28*b*, and 30 on forward swing path guide 13 as shown. The view of FIG. 9 superimposes a typical club 72 (a 8-iron in this example) with club face 70 positioned adjacent ball 16 in a target alignment position utilizing club face alignment tab 37 and a line of sight alignment to the flag through target line marker 26*b* and target line marker 24*b*.

Figure 10:
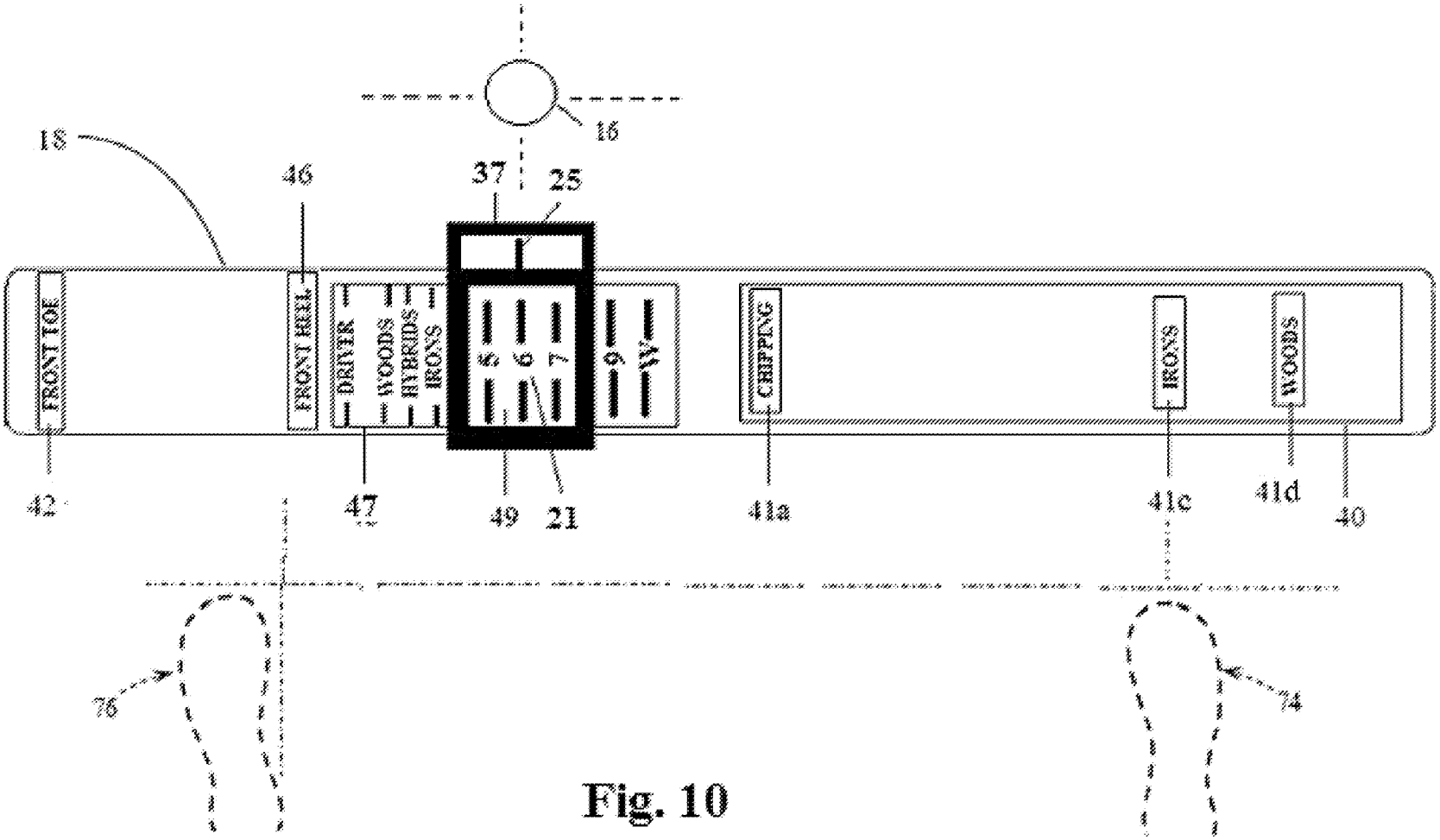
FIG. 10 is a detailed top plan view of an embodiment of the golf swing training device of the present invention.

Reference is next made to FIG. 10 for a more detailed description of an embodiment of the club selection bar 18. A golf ball 16 is shown for reference to illustrate the alignment of the golf ball 16 with the club face alignment indicia 25 and the golf club (not shown) as illustrated by the dashed lines. In this embodiment the purpose of club selection bar 18 is to facilitate the proper placement of the golfer's feet 76 and 74 and the placement of the ball 16 within the stance and proper alignment with the club face alignment indicia 25 in a manner that varies with regard to club selection. The golfer will typically identify a specific golf club to be used depending on the distance to the target. Once the club to be used is selected, the club face alignment tab 37 is placed on the club selection bar 18 and moved left or right until the club indicia 21 for the club selected (a 6-iron in this example) is visible through the club face alignment window 49 and the line on the club indicia 21 is aligned with the club face alignment indicia 25 on the club face alignment tab 37. Once club face alignment tab 37 is moved to the alignment position for the desired club the golfer then uses the indicia for placement of the golfer's feet 76 & 74 by referring to at least one of the back foot marker section 40, front toe marker 42, and front heel marker 46.

Reference is next made to FIG. 11 for a detailed description of the forward swing path guide 13 portion of the golf swing training device, which in some embodiments is an arrowhead shaped frame of flexible or rigid sheet material, unitary or multipart, and a portion of the club selection bar 18, both of which are placed on the ground with the forward swing path guide 13 having an alignment orientation towards the target (flag or hole) and the club selection bar 18 positioned parallel to the stance guide marker 80*b* for right handed golfers. Embodiments may include indicia for the stance guide markers, 80*a* for a left handed golfer and 80*b* for a right handed golfer, which are used as reference markers in order to place the club selection bar 18 in a line parallel to the alignment path indicated by the swing path guide 13. The set up for a left handed golfer would show the club selection bar 18 aligned with the left-handed stance guide marker 80*a*. The front toe marker 42 and the front heel marker 46 are shown for reference. This configuration of the swing path guide 13 and the club selection bar 18 presents an overall arrow like configuration to the golfer for an accurate orientation of a golfer's proper set up and swing. The indicia associated with the forward swing path guide 13 may include target line marker 26*b* and/or target line marker 24*b*. Because the golfer's swing seldom involves a straight line motion because of its pivoting nature, the actual swing paths are marked with indicia for a swing path of a draw shot 28*b* for a right handed golfer and 30 for a left handed golfer, and a swing path for a fade shot 30 for a right handed golfer and 28*b* for a left handed golfer. Further, the embodiment of FIG. 11 may include visual and audio feedback devices 100*a*, 100*b*, and 100*c*, and the display screen for club head speed 90, which are activated when the head of the golf club passes over the motion sensors for lights, audio, and speed sensors 102*a* and 102*b*.

Figure 12:
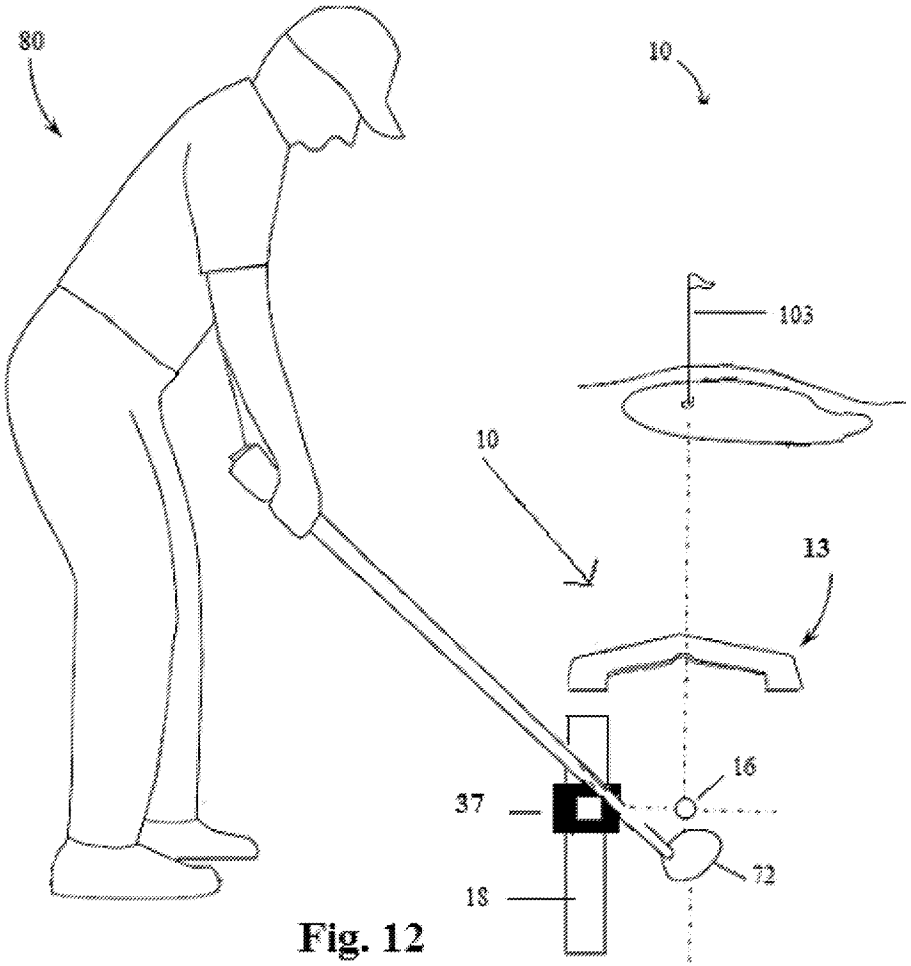
FIG. 12 is a perspective view of an embodiment of the golf swing training device of the present invention in use by a golfer directed towards a target hole.

Reference is next made to FIG. 12 which shows a golfer 80 positioned in association with golf training device 10 of an embodiment of the present invention with the ball 16 and the club head 72 positioned in alignment to the flag 103 as indicated by swing path guide 13 club selection bar 18 and club face alignment tab 37.

Yet another embodiment is shown in FIG. 13 whereby the club selection bar 18 is positioned on a removable section of the template frame 12 which includes the lower club face alignment tab 38. When used by a left handed golfer, the removable section of the template frame 12 having the upper club face alignment tab 36 would be used. The purpose of club selection bar 18 is to facilitate the proper placement of the golfer's feet and the placement of the ball in a manner that varies with regard to club selection. Indicia on the club selection bar 18 may be oriented orthogonal to the longitudinal axis of the club selection bar 18 so that it may be used for either right or left handed golfers. In this embodiment, once a club has been selected the golfer may slide club selection bar 18 in relation to the portion of the frame to align the appropriate selection bar club indicia 21 with the club face selection lines 39 positioned on lower club face alignment tab 38. By shifting club selection bar 18 to the left or right the indicators for placement of the golfer's feet (back foot marker 40 and lead foot marker 42) are also moved, as is the heel marker for woods and irons 46.

Figure 14:
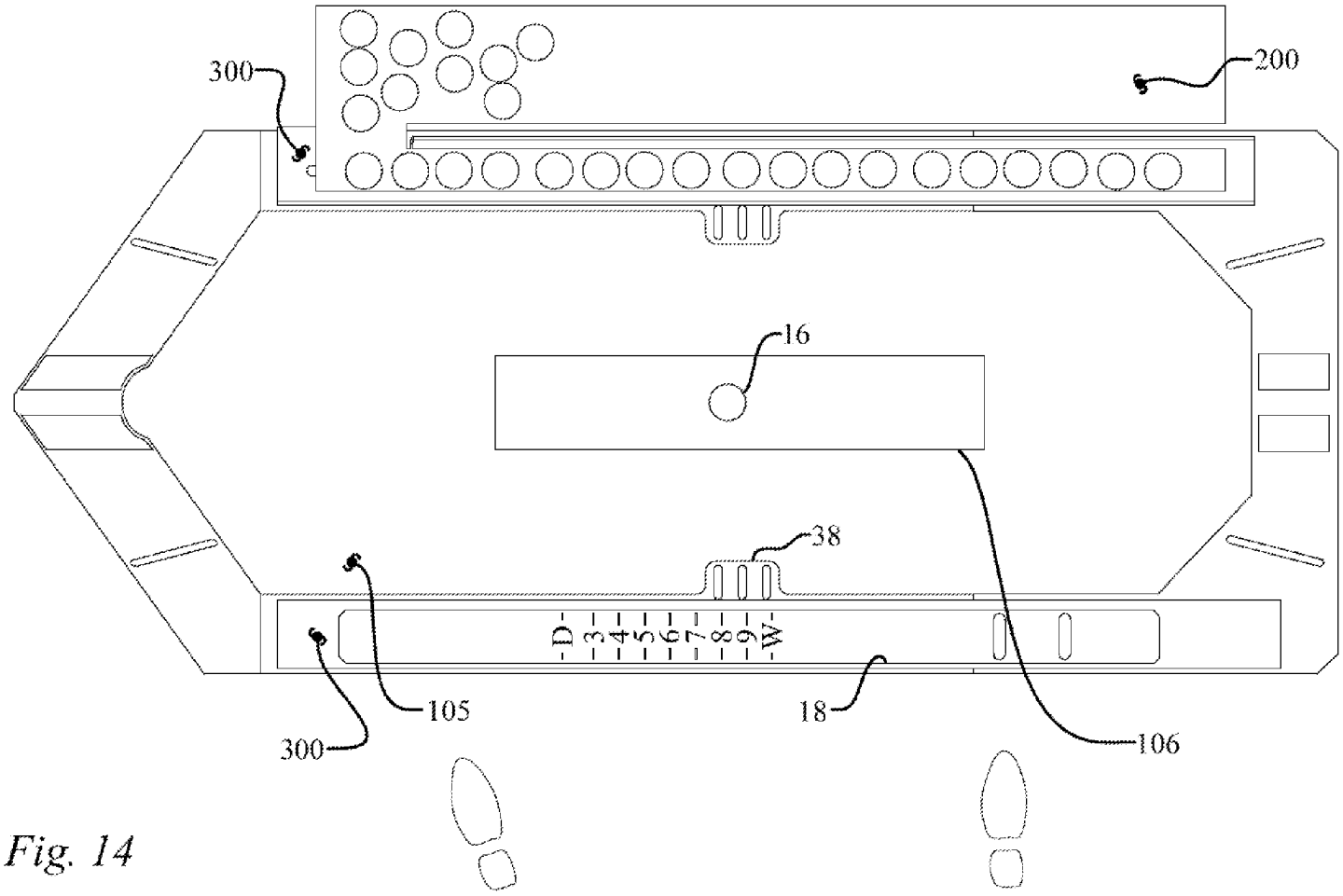
FIG. 14 is a detailed top plan view of an embodiment of the golf swing training device of the present invention.

Additional embodiments are illustrated in FIGS. 14, 24, and 25 whereby any of the previously described components may be permanently, or removably, attached to a mat 105. In another embodiment the mat 105 may include a removable hitting section 106, seen in FIG. 14. Yet a further embodiment includes a removable ball tray 200 that cooperates with a portion of the template frame 12.

Figure 15:
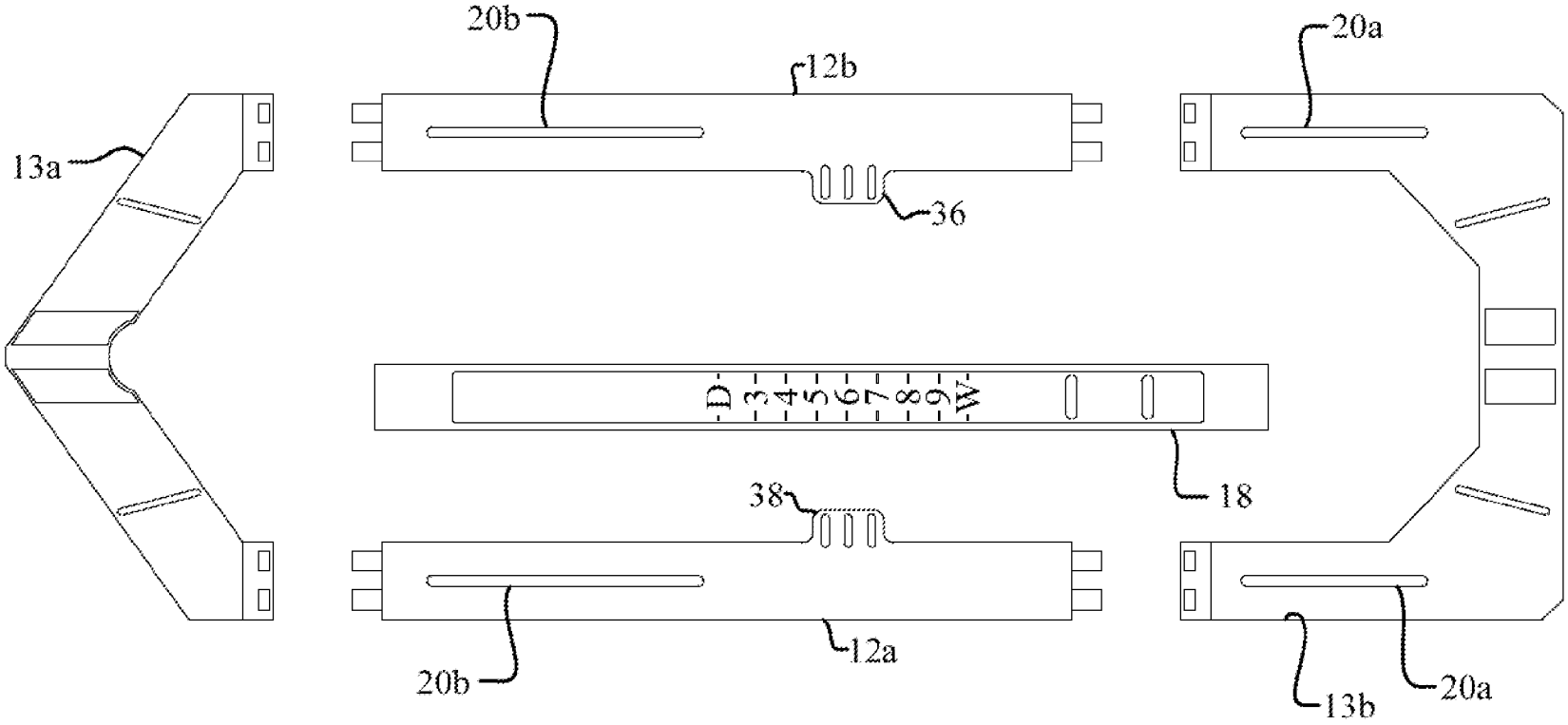
FIG. 15 is a detailed top plan view of an embodiment of the golf swing training device of the present invention.

Now, with reference to all of the figures, the adjustable golf swing training device 10 includes a template frame 12 partially surrounding and defining a ball hitting area, wherein the template frame 12 includes a primary longitudinal frame section 12*a* and a forward swing path guide 13, and a club face alignment tab, as seen in FIG. 15. Thus, in this embodiment the frame 12 need only have at least two sides, namely the primary longitudinal frame section 12*a* and the forward swing path guide 13, and they need not be connected, however in alternative embodiments they are connected and in even further embodiments they are integrally formed. In this embodiment the club face alignment tab of the primary longitudinal frame section 12*a* is a lower club face alignment tab 38. This embodiment further includes a club selection bar 18 slidably cooperating with the primary longitudinal frame section 12*a*.

As previously touched upon, in this particular embodiment the forward swing path guide 13 includes at least one forward target line marker and at least one forward swing path marker, as seen best in FIG. 4A, which in a further embodiment may include a forward draw shot swing path marker 28*b* and/or a forward fade shot swing path marker 30. The club selection bar 18 includes club indicia 21, seen best in FIGS. 1 and 13, a front foot marker, and a back foot marker 40 in predetermined fixed locations along the length of the club selection bar 18. In one particular embodiment the front foot marker includes a front toe marker 42 and a front heel marker 46. In a further embodiment the back foot marker 40 includes at least two markers for differing golf clubs; which in a further embodiment includes markers for at least 3 iron-type golf clubs and at least 2 wood-type golf clubs, while in an even further embodiment markers for hybrid-type golf clubs are included. Similarly, in another embodiment the back foot marker 40 includes at least a back foot chipping marker 41*a* and a back foot wood marker 41*d*.

As should now be apparent for this embodiment, movement of the club selection bar 18 with respect to the primary longitudinal frame section 12*a* aligns the club indicia 21 for one of the multiple different golf clubs with the club face alignment tab and establishes the location of the front foot marker and the back foot marker to inform a user of the proper foot locations for the golf club when a golf ball is positioned in the ball hitting area and aligned with the club face alignment tab.

Further embodiments, such as those seen in FIGS. 15 and 21, includes a rearward swing path guide 17 having at least one rearward target line marker and at least one rearward swing path marker. In an even further embodiment the primary longitudinal frame section 12*a* is in contact with the forward swing path guide 13 and the rearward swing path guide 17 at opposite ends of the primary longitudinal frame section 12*a*, and rotationally attached in the embodiment of FIG. 21, and the practice positions of the primary longitudinal frame section 12*a*, the forward swing path guide 13, and the rearward swing path guide 17 define the boundary of the ball hitting area, and the ball hitting area is 2.0-10.0 square feet, while in a further embodiment the ball hitting area is 3.0-9.0 square feet, while in an even further embodiment the ball hitting area is 4.0-8.0 square feet, or even 5.0-7.5 square feet. In one particular embodiment the ball hitting area is less than 6.0 square feet, while in another embodiment it is less than 5.0 square feet, while in an even further embodiment the ball hitting area is less than 4.0 square feet. Such small ball hitting areas allow the user to really fine tune their swing and practice more precise swing paths based upon the close proximity of the markers.

In one embodiment the forward swing path guide 13 is formed in the shape of an arrowhead as seen in FIG. 15, while in other embodiments the forward swing path guide 13 is a straight section as seen in FIG. 21. In one such straight section embodiment, the forward swing path guide 13 and the rearward swing path guide 17 are straight sections that are perpendicular to the primary longitudinal frame section 12*a* when in the practice position, seen in FIG. 21. In another embodiment the forward swing path guide 13 and the rearward swing path guide 17 are rotationally connected to the primary longitudinal frame section 12*a*, as seen in FIG. 22, and may rotate to align with the primary longitudinal frame section 12*a* in a compact storage position.

The target line markers, forward and rearward, may consist of a single markers, or line, or may include multiple markers, or lines. In one embodiment the forward target line marker is approximately at the midpoint of the forward swing path guide 13 and the rearward target line marker is approximately at the midpoint of the rearward swing path guide 17, and the forward swing path marker and the rearward swing path marker are located on opposites sides of an imaginary line connecting the forward target line marker and the rearward target line marker. In a further embodiment the club indicia 21 on the club selection bar 18 is oriented perpendicular to the longitudinal axis of the club selection bar 18 so that the adjustable golf swing training device may be used in a right-hand configuration or a left-hand configuration with the club selection bar 18.

The template frame 12 may include a secondary longitudinal frame section 12*b*, as seen in FIG. 15, wherein the secondary longitudinal frame section 12*b* is in contact with the forward swing path guide 13 and the rearward swing path guide 17 at opposite ends from the primary longitudinal frame section 12*a*, and the template frame 12 totally encloses and defines the ball hitting area, and the ball hitting area is 2.0-10.0 square feet, or any of the prior ball hitting area embodiments. In a further embodiment the primary longitudinal frame section 12*a* includes a lower club face alignment tab 38 and the secondary longitudinal frame section 12*b* includes an upper club face alignment tab 36, the lower club face alignment tab 38 and the upper club face alignment tab 36 are aligned with each other on opposite sides of the ball hitting area, the forward target line marker and the rearward target line marker are aligned with each other on opposite sides of the ball hitting area, and ball-locating crosshair is formed by the upper club face alignment tab 36, the lower club face alignment tab 38, the forward target line marker, and the rearward target line marker, as seen in FIG. 1.

In one embodiment a portion of the club selection bar 18 slides on an upward facing surface of the primary longitudinal frame section 12*a*, as seen in FIG. 3A, and a portion of the club selection bar 18 and the primary longitudinal frame section 12*a* cooperate to restrain the club selection bar 18 to longitudinal movement and prevent rotation. In one embodiment at least a portion of the club selection bar 18 projects vertically from the upward facing surface of the primary longitudinal frame section 12*a* a distance so that a portion of the golf club can engage and slide the club selection bar 18. The primary longitudinal frame section 12*a* may include at least one selection bar slot 20*b*, the club selection bar 18 may include at least one selection bar slot tab 19*b*, and the selection bar slot 20*b* and the selection bar slot tab 19*b* may cooperate for longitudinal movement of the club selection bar 18 and prevent rotation of the club selection bar 18, as seen in FIG. 3A. Alternatively, in another embodiment the club selection bar 18 includes at least one selection bar slot, the primary longitudinal frame section 12*a* includes at least one selection bar slot tab, and the selection bar slot and the selection bar slot tab cooperate for longitudinal movement of the club selection bar 18 and prevent rotation of the club selection bar 18. In an even further embodiment, such as that seen in FIG. 14, the selection bar slot 20*b* may be a recess 300 large enough to receive a portion of the club selection bar 18 and cooperate with a portion of the perimeter of the selection bar 18 to promote longitudinal movement and prevent rotation. In one such embodiment the entire perimeter of the selection bar 18 is bounded by the recess 300, while in an even further embodiment the selection bar 18 may be releasably locked in the recess 300 so that it may slide longitudinally, but cannot be dislodged from the recess 300, even if held upside-down. The releasable interconnection may be a quick-release connection such as a quarter-turn connection or the like so that the selection bar 18 may be easily removed and installed on the opposite portion of the frame 12 for opposite hand users.

In an alternative family of embodiments a slider tab 37 may be used with, or in lieu of, club selection bar 18, as seen best in FIGS. 9, 10, 12, 19, 23, and 25. The slider tab 37 may include club face alignment indicia 25 and slidably cooperating with the club selection bar 18 or mat 105. Movement of the slider tab 37 with respect to the club selection bar 18, or mat 105, aligns the slider tab 37 with the club indicia 21 for one of the multiple different golf clubs and establishes the location of a golf ball, the front foot marker, and the back foot marker to inform a user of the proper golf ball placement and foot locations for the golf club. In one embodiment a portion of the slider tab 37 slides on an upward facing surface of the club selection bar 18, and a portion of the slider tab 37 and the club selection bar 18 cooperate to restrain the slider tab 37 to longitudinal movement and prevent rotation. In another embodiment at least a portion of the slider tab 37 projects vertically from the upward facing surface of the club selection bar 18 a distance of at least ⅛" so that a portion of the golf club can engage and slide the slider tab 37, with further embodiments equivalent to those described with respect to the club selection bar 18 to promote ease of movement with a golf club. In a further embodiment the club selection bar 18 includes at least one selection bar slot, the slider tab 37 includes at least one selection bar slot tab, and the selection bar slot and the selection bar slot tab cooperate for longitudinal movement of the slider tab 37 and prevent rotation of the slider tab 37.

Although the present invention has been described in terms of the foregoing preferred embodiments, this description has been provided by way of explanation only, and is not intended to be construed as a limitation of the invention. Those skilled in the art will recognize modifications in the present invention that might accommodate specific golfers and specific golf course environments and conditions. Such modifications as to structure, method, and even the specific arrangement of components, where such modifications are coincidental to the golfer or the training environment or to the specific set of clubs being used by the golfer, do not necessarily depart from the spirit and scope of the invention.

I claim:

1. An adjustable golf swing training device for use with multiple different golf clubs, the training device comprising:

a template frame partially surrounding and defining a ball hitting area, wherein the template frame includes a primary longitudinal frame section, a forward swing path guide, and a club face alignment tab in a fixed location along the primary longitudinal frame section; and a club selection bar parallel to, and slidably cooperating with, the primary longitudinal frame section, wherein:

the forward swing path guide includes at least one forward target line marker and at least one forward swing path marker;

the club selection bar includes club indicia having scoring club indicia and mid-and-long iron indicia, a front foot marker, and a back foot marker in predetermined fixed locations along the length of the club selection bar, and wherein majority of the club selection bar is in contact with the primary longitudinal frame section; and movement of the club selection bar with respect to the primary longitudinal frame section aligns the scoring club indicia or the mid-and-long iron indicia with the club face alignment tab and establishes the location of the front foot marker and the back foot marker to inform a user of the proper foot locations for the golf club when a golf ball is positioned in the ball hitting area and aligned with the club face alignment tab.

2. The device of claim 1, wherein the template frame further includes a rearward swing path guide having at least one rearward target line marker and at least one rearward swing path marker.

3. The device of claim 2, wherein the primary longitudinal frame section is in contact with the forward swing path guide and the rearward swing path guide at opposite ends of the primary longitudinal frame section, and the practice positions of the primary longitudinal frame section, the forward swing path guide, and the rearward swing path guide define the boundary of the ball hitting area, and the ball hitting area is 2.0-10.0 square feet.

4. The device of claim 2, wherein the forward swing path guide and the rearward swing path guide are straight sections that are perpendicular to the primary longitudinal frame section when in the practice position.

5. The device of claim 2, wherein the forward target line marker is approximately at the midpoint of the forward swing path guide and the rearward target line marker is approximately at the midpoint of the rearward swing path guide, and the forward swing path marker and the rearward swing path marker are located on opposites sides of an imaginary line connecting the forward target line marker and the rearward target line marker.

6. The device of claim 5, wherein the club indicia on the club selection bar is oriented perpendicular to the longitudinal axis of the club selection bar so that the adjustable golf swing training device may be used in a right-hand configuration or a left-hand configuration with the club selection bar.

7. The device of claim 2, wherein the front foot marker includes a front toe marker and a front heel marker.

8. The device of claim 2, wherein the back foot marker includes at least two markers for differing golf clubs.

9. The device of claim 1, wherein majority of the club selection bar slides on an upward facing surface of the primary longitudinal frame section, and a portion of the club selection bar and the primary longitudinal frame section cooperate to restrain the club selection bar to longitudinal movement and prevent rotation.

10. The device of claim 9, wherein at least a portion of the club selection bar projects vertically from the upward facing surface of the primary longitudinal frame section a distance of at least ⅛" so that a portion of the golf club can engage and slide the club selection bar.

11. The device of claim 9, wherein the upward facing surface of the primary longitudinal frame section includes at least one selection bar slot, the club selection bar includes at least one selection bar slot tab, and the selection bar slot and the selection bar slot tab cooperate for longitudinal movement of the club selection bar and prevent rotation of the club selection bar.

12. The device of claim 11, wherein the selection bar slot is a recess large enough to receive a portion of the club selection bar cooperate with a portion of the perimeter of the selection bar to promote longitudinal movement and prevent rotation.

13. The device of claim 9, wherein a downward facing surface of the club selection bar includes at least one selection bar slot, the upward facing surface of the primary longitudinal frame section includes at least one selection bar slot tab, and the selection bar slot and the selection bar slot tab cooperate for longitudinal movement of the club selection bar and prevent rotation of the club selection bar.

14. An adjustable golf swing training device for use with multiple different golf clubs, the training device comprising:

a template frame including a forward swing path guide;

a club selection bar; and a slider tab having club face alignment indicia and slidably cooperating with the club selection bar, wherein:

the forward swing path guide includes at least one forward target line marker and at least one forward swing path marker;

the club selection bar includes club indicia, a front foot marker, and a back foot marker in predetermined fixed locations along the length of the club selection bar; and movement of the slider tab with respect to the club selection bar aligns the slider tab with the club indicia for one of the multiple different golf clubs and establishes the location of a golf ball, the front foot marker, and the back foot marker to inform a user of the proper golf ball placement and foot locations for the golf club.

15. The device of claim 14, further including a rearward swing path guide having at least one rearward target line marker and at least one rearward swing path marker.

16. The device of claim 14, wherein the club indicia on the club selection bar is oriented perpendicular to the longitudinal axis of the club selection bar so that the adjustable golf swing training device may be used in a right-hand configuration or a left-hand configuration with the club selection bar.

17. The device of claim 14, wherein the front foot marker includes a front toe marker and a front heel marker.

18. The device of claim 14, wherein the back foot marker includes at least two markers for differing golf clubs.

19. The device of claim 14, wherein at least a portion of the slider tab slides on an upward facing surface of the club selection bar, and a portion of the slider tab and the club selection bar cooperate to restrain the slider tab to longitudinal movement and prevent rotation.

20. The device of claim 14, wherein at least a portion of the slider tab projects vertically from the upward facing surface of the club selection bar a distance of at least ⅛" so that a portion of the golf club can engage and slide the slider tab.

* * * * *